US011453952B2

(12) United States Patent
Alrobei et al.

(10) Patent No.: US 11,453,952 B2
(45) **Date of Patent: *Sep. 27, 2022**

(54) PHOTOELECTROCHEMICAL CELLS

(71) Applicant: UNIVERSITY OF SOUTH FLORIDA, Tampa, FL (US)

(72) Inventors: Hussein Alrobei, Tampa, FL (US); Manoj Kumar Ram, Palm Harbor, FL (US)

(73) Assignee: UNIVERSITY OF SOUTH FLORIDA, Tampa, FL (US)

( * ) Notice: Subject to any disclaimer, the term of this patent is extended or adjusted under 35 U.S.C. 154(b) by 122 days.

This patent is subject to a terminal disclaimer.

(21) Appl. No.: 16/793,815

(22) Filed: Feb. 18, 2020

(65) Prior Publication Data

US 2020/0181784 A1 Jun. 11, 2020

Related U.S. Application Data

(62) Division of application No. 16/030,625, filed on Jul. 9, 2018, now Pat. No. 10,563,312.

(60) Provisional application No. 62/531,004, filed on Jul. 11, 2017.

(51) Int. Cl.

| | |
|---|---|
| ***C25B 11/095*** | (2021.01) |
| ***C25B 1/04*** | (2021.01) |
| ***C25B 11/04*** | (2021.01) |
| ***C25B 1/55*** | (2021.01) |
| ***C25B 9/17*** | (2021.01) |
| ***C25B 11/051*** | (2021.01) |
| ***C25B 11/057*** | (2021.01) |
| ***C25B 11/091*** | (2021.01) |

(52) U.S. Cl.

CPC ..... *C25B 11/095* (2021.01); *C25B 1/04* (2013.01); *C25B 1/55* (2021.01); *C25B 9/17* (2021.01); *C25B 11/04* (2013.01); *C25B 11/051* (2021.01); *C25B 11/057* (2021.01); *C25B 11/091* (2021.01)

(58) Field of Classification Search

None

See application file for complete search history.

(56) References Cited

U.S. PATENT DOCUMENTS 4,240,882 A * 12/1980 Ang ..... C25B 1/55 205/340
4,366,215 A * 12/1982 Coetzer ..... H01M 10/36 429/199
4,414,080 A * 11/1983 Williams ..... C25B 1/55 205/340
4,437,954 A * 3/1984 Sammells ..... H01M 8/0656 205/340

(Continued)

OTHER PUBLICATIONS

Alrobei et al, A New Insight in the Physical and Photoelectrochemical Properties of Molybdenum Disulfide Alpha-Hematite Nanocomposite Films, American Journal of Analytical Chemistry, vol. 8, Aug. 2017, pp. 523-539 (Year: 2017).*

(Continued)

*Primary Examiner* — Harry D Wilkins, III

(74) *Attorney, Agent, or Firm* — Quarles and Brady LLP

(57) ABSTRACT

Photoelectrochemical cells including a cathode including alpha-hematite and a metal dichalcogenide, an anode including a conducting polymer, and an electrolyte.

14 Claims, 27 Drawing Sheets

(56) References Cited

U.S. PATENT DOCUMENTS

| | | | | |
|---|---|---|---|---|
| 4,492,743 | A * | 1/1985 | Howe | C25B 1/55 429/111 |
| 9,416,456 | B1 * | 8/2016 | Ram | C25B 1/55 |
| 9,735,306 | B2 * | 8/2017 | Carter | H01L 31/032 |
| 2010/0133110 | A1 * | 6/2010 | Nocera | H01M 14/005 205/340 |
| 2012/0267234 | A1 * | 10/2012 | Reece | C01B 3/042 204/157.5 |
| 2015/0340166 | A1 * | 11/2015 | Ren | H01G 9/20 136/254 |
| 2016/0193595 | A1 * | 7/2016 | Nagpal | B01J 23/72 502/215 |

OTHER PUBLICATIONS

Zhang et al, Structural evolution and characteristics of the phase transformations between alpha-Fe2O3, Fe3O4, and gamma-Fe2O3 nanoparticles under reducing and oxidizing atmospheres, CrystEngComm, vol. 15, Aug. 2013, pp. 8166-8172 (Year: 2013).*

Ahn et al, MoSx supported hematite with enhanced photoelectrochemical performance, Journal of Materials Chemistry A, vol. 3, Oct. 2015, pp. 21444-21450 (Year: 2015).*

Ram et al, Novel Nanohybrid Structured Regioregular Polyhexylthiophene Blend Films for Photoelectrochemical Energy Applications, The Journal of Physical Chemistry C, vol. 115, No. 44, Sep. 2011, pp. 21987-21995 (Year: 2011).*

Sivula et al, Solar Water Splitting: Progress Using Hematite (alpha-Fe2O3) Photoelectrodes, ChemSusChem, vol. 4, No. 4, Apr. 2011, pp. 432-449 (Year: 2011).*

Sun et al, MoS2 and graphene as dual, cocatalysts for enhanced visible light photocatalytic activity of Fe2O3, Journal of Sol-Gel Science and Technology, vol. 80, No. 3, Aug. 2016 (first online), pp. 719-727 (Year: 2016).*

* cited by examiner

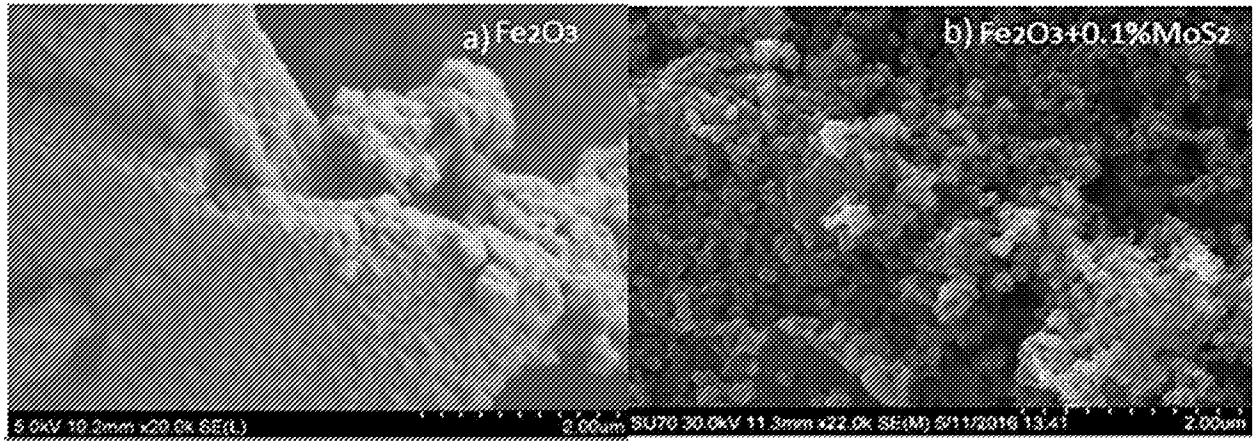
FIG. 14A
FIG. 14B
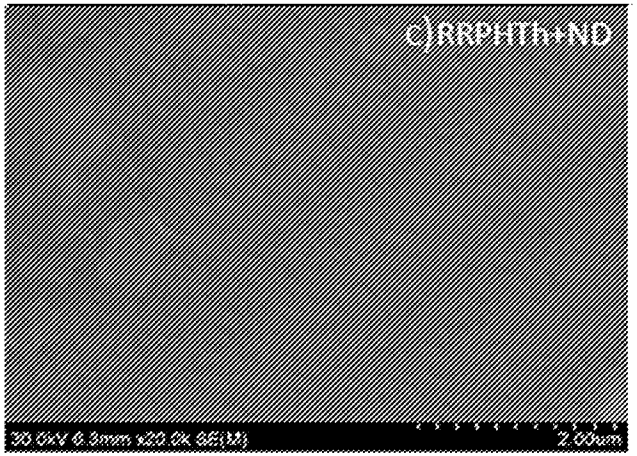
FIG. 14C

ND-RRPHTh

PHOTOELECTROCHEMICAL CELLS

CROSS-REFERENCE TO RELATED APPLICATIONS

This application is a divisional application of U.S. application Ser. No. 16/030,625 filed on Jul. 9, 2018, which claims the benefit of and priority to U.S. Provisional Application No. 62/531,004, filed on Jul. 11, 2017, the entire contents of which are fully incorporated herein by reference.

BACKGROUND OF THE INVENTION

Photoelectrochemical cells have been used to convert solar energy to hydrogen gas by splitting water into hydrogen and oxygen, hence offering the possibility of clean and renewable energy. Many photoelectrochemical cells have used titanium dioxide ($TiO_2$), but the large band gap of $TiO_2$ (about 3.1-3.3 eV) impedes the absorption of visible light and limits the solar-to-hydrogen efficiency to about 2.2%. So, it is necessary to use other materials that have a smaller band gap and can more efficiently harvest energy from sunlight.

There are many semiconductor materials with a lower band gap than $TiO_2$, such as iron oxide ($Fe_2O_3$), bismuth vanadium oxide ($BiVO_4$), tungsten oxide ($WO_3$) and tantalum nitride ($Ta_3N_5$), for example. Alpha ($\alpha$)-hematite, in particular, has a solar-to-hydrogen conversion efficiency of about 16%. Additionally, $\alpha$-$Fe_2O_3$ has a low bandgap (2.1-2.2 eV), low cost, high chemical stability, nontoxicity, and natural abundance. It has several drawbacks as well, however, such as a relatively short hole diffusion length, low conductivity, shorter lifetime of photoexcitation, and deprived reaction kinetics of oxygen evolution. Some have tried doping with certain metals, such as titanium (Ti), molebdenum (Mo), aluminum (Al), zinc (Zn), platinum (Pt), and silicon (Si), for example, to improve the PEC performance of $\alpha$-$Fe_2O_3$.

SUMMARY OF THE INVENTION

The present invention relates to photoelectrochemical cells (PEC). More particularly, it relates to photoelectrochemical cells including $\alpha$-$Fe_2O_3$ and molybdenum disulfide ($MoS_2$).

In one embodiment, the invention provides a photoelectrochemical cell, which includes a cathode that includes $\alpha$-$Fe_2O_3$ and a metal dichalcogenide, an anode that includes a conducting polymer, and an electrolyte.

In another embodiment, the invention provides a method of producing a photoelectrochemical cell, which includes a cathode that includes $\alpha$-$Fe_2O_3$ and a metal dichalcogenide, an anode that includes a conducting polymer, and an electrolyte.

In yet another embodiment, the invention provides a method of generating hydrogen from water with a photoelectrochemical cell, which includes a cathode that includes $\alpha$-$Fe_2O_3$ and a metal dichalcogenide, an anode that includes a conducting polymer, and an electrolyte.

Other aspects of the invention will become apparent by consideration of the detailed description and accompanying drawings.

BRIEF DESCRIPTION OF THE DRAWINGS

FIGS. 14A-14C show scanning electron micrographs (SEM) of $Fe_2O_3$ (FIG. 14A), $Fe_2O_3$+0.1% $MoS_2$ (FIG. 14B), and regioregular polyhexylthiophene (RRPHTh)+nanodiamond (ND) (FIG. 14C).

DETAILED DESCRIPTION

Figure 1:
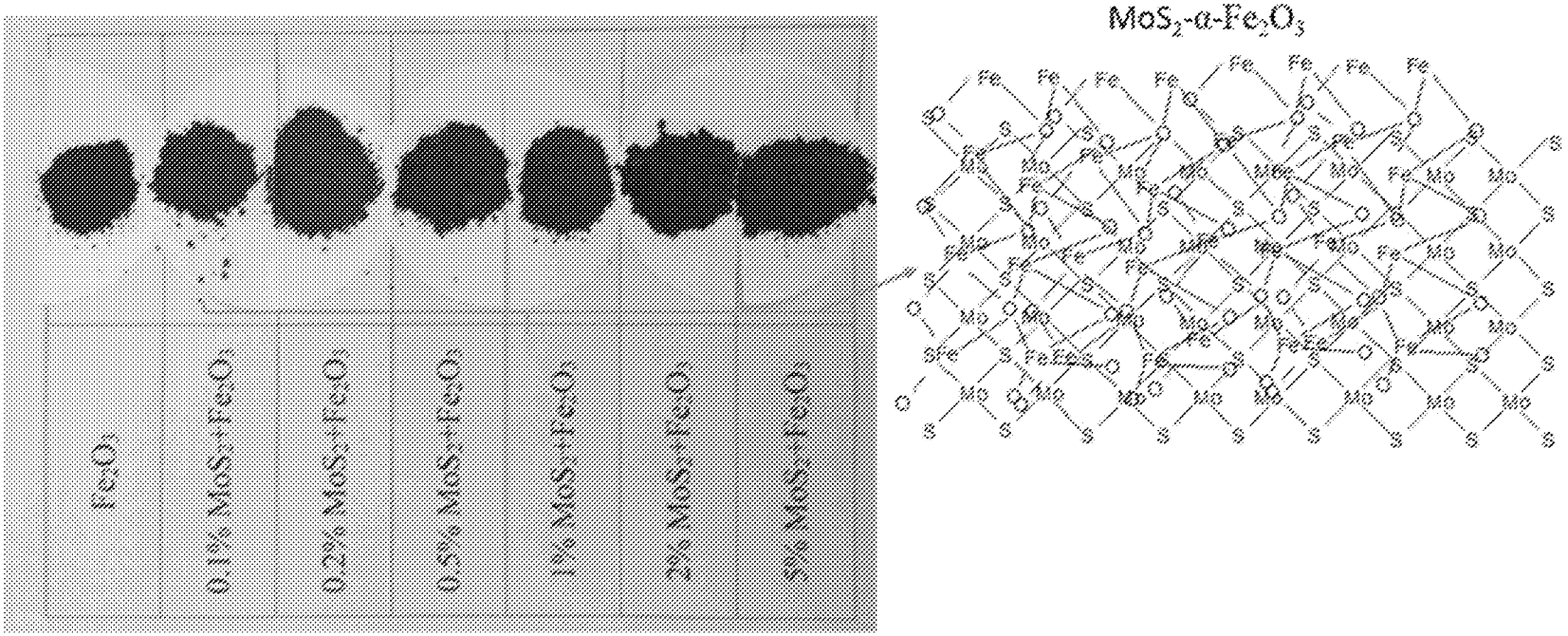
FIG. 1 shows the chemical structure and photographs of $MoS_2$-$\alpha$-$Fe_2O_3$ nanomaterial.
Figure 2A:
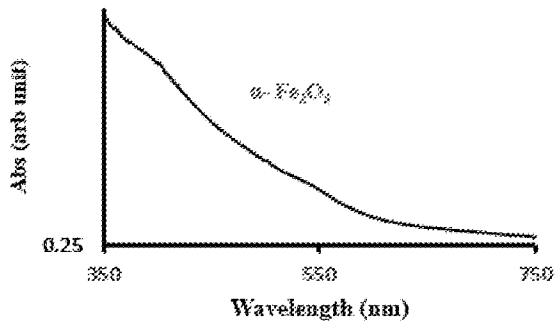
FIGS. 2A-2F show UV-visible absorption spectra of $MoS_2$ with $\alpha$-$Fe_2O_3$ nanocomposite.
Figure 2B:
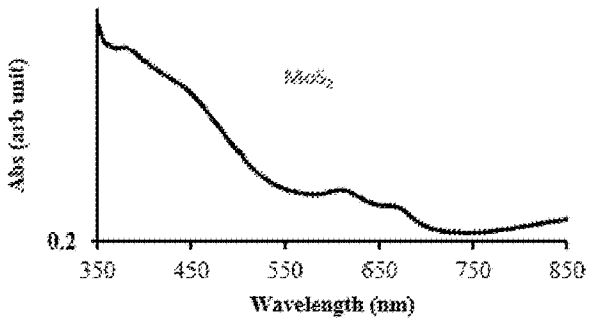
Figure 2C:
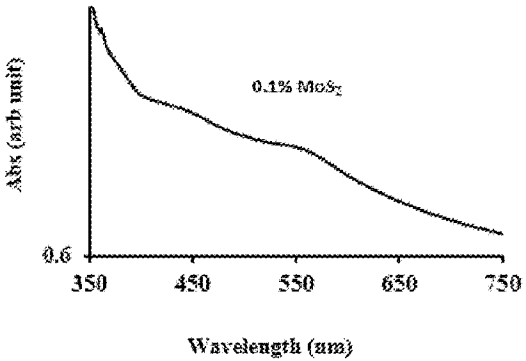
Figure 2D:
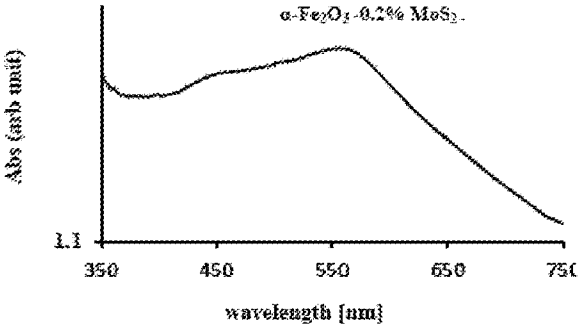
Figure 2E:
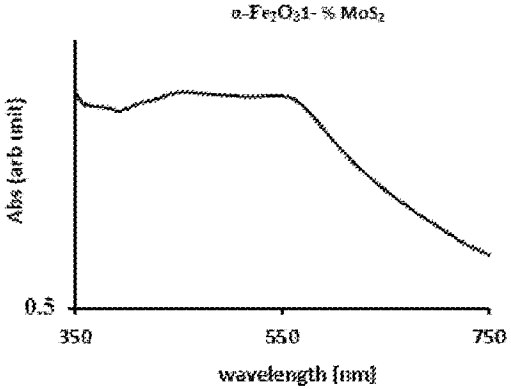
Figure 2F:
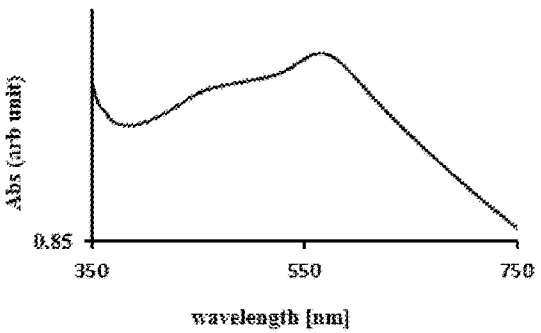

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The terms "comprise(s)," "include(s)," "having," "has," "can," "contain(s)," and variants thereof, as used herein, are intended to be open-ended transitional phrases, terms, or words that do not preclude the possibility of additional acts or structures. The singular forms "a," "and," and "the" include plural references unless the context clearly dictates otherwise. The present disclosure also contemplates other embodiments "comprising," "consisting of," and "consisting essentially of," the embodiments or elements presented herein, whether explicitly set forth or not.

The conjunctive term "or" includes any and all combinations of one or more listed elements associated by the conjunctive term. For example, the phrase "an apparatus comprising A or B" may refer to an apparatus including A where B is not present, an apparatus including B where A is not present, or an apparatus where both A and B are present. The phrase "at least one of A, B, . . . and N" or "at least one of A, B, . . . N, or combinations thereof" are defined in the broadest sense to mean one or more elements selected from the group comprising A, B, . . . and N, that is to say, any combination of one or more elements A, B, . . . or N including any one element alone or in combination with one or more of the other elements, which may also include, in combination, additional elements not listed.

The modifier "about" used in connection with a quantity is inclusive of the stated value and has the meaning dictated by the context (for example, it includes at least the degree of error associated with the measurement of the particular quantity). The modifier "about" should also be considered as disclosing the range defined by the absolute values of the two endpoints. For example, the expression "from about 2 to about 4" also discloses the range "from 2 to 4". The term "about" may refer to plus or minus 10% of the indicated number. For example, "about 10%" may indicate a range of 9% to 11%, and "about 1%" may mean from 0.9-1.1. Other meanings of "about" may be apparent from the context, such as rounding off, so, for example "about 1" may also mean from 0.5 to 1.4.

For the recitation of numeric ranges herein, each intervening number there between with the same degree of precision is explicitly contemplated. For example, for the range of 6-9, the numbers 7 and 8 are contemplated in addition to 6 and 9, and for the range 6.0-7.0, the number 6.0, 6.1, 6.2, 6.3, 6.4, 6.5, 6.6, 6.7, 6.8, 6.9, and 7.0 are explicitly contemplated.

Unless otherwise defined, all technical and scientific terms used herein have the same meaning as commonly understood by one of ordinary skill in the art. In case of conflict, the present document, including definitions, will control. Preferred methods and materials are described below, although methods and materials similar or equivalent to those described herein can be used in practice or testing of the present invention. All publications, patent applications, patents and other references mentioned herein are incorporated by reference in their entirety. The materials, methods, and examples disclosed herein are illustrative only and not intended to be limiting.

1. PHOTOELECTROCHEMICAL CELL

In one aspect, provided is a photoelectrochemical cell comprising:

(a) a cathode comprising $\alpha$-hematite and a metal dichalcogenide;

(b) an anode comprising a conducting polymer; and (c) an electrolyte.

In some embodiments, the $\alpha$-hematite includes a dopant. Suitable dopants include, but are not limited to platinum, tin, cobalt, zinc, palladium, titanium, chromium, rhodium, iridium, and combinations thereof.

Suitable metal dichalcogenides include, but are not limited to, molybdenum disulfide, tungsten disulfide, molybdenum diselenide, molybdenum telluride, tungsten selenide, and combinations thereof. In certain embodiments, the metal dichalcogenide is molybdenum disulfide ($MoS_2$). The content of the metal dichalcogenide may range from about 0.1% to about 10% in $\alpha$-hematite, including from about 0.1% to about 5%, from about 0.1% to about 1%, or from about 1% to about 5%. In certain embodiments, the content of the metal dichalcogenide is at a level of about 0.1%, about 0.2%, about 0.5%, about 1%, about 2%, or about 5% in $\alpha$-hematite. In some embodiments, the metal dichalcogenide is $MoS_2$ at a level of about 0.1%, about 0.2%, about 0.5%, about 1%, about 2%, or about 5% in $\alpha$-hematite.

Suitable conducting polymers include, but are not limited to polythiophenes, polyhexylthiophene, regioregular polyhexylthiophene, polyethylenedioxythiophene, polymethylthiophene, polydodcylthiophene, polycarbazole, poly(n-vinylcarbazole), substituted polyethylenedioxythiophenes, polydiooxythiophene, polyaniline, n-poly(N-methyl aniline), poly(o-ethoxyaniline), poly(o-toluidine), poly(phenylene vinylene), and combinations thereof.

In some embodiments, the anode includes an electron acceptor. Suitable electron acceptors include, but are not limited to, diamond, nanodiamond, hexagonal boro-nitride (hBN), graphite, methyl [6, 6]-phenyl-C61-butyrate (PCBM), 2,4,7-trtinitro-9-fluorenone, copper-phthalocyanines, and combinations thereof.

Suitable electrolytes include, but are not limited to, aqueous electrolytes known in the art. In some embodiments, the electrolyte is a an aqueous electrolyte which comprises sodium hydroxide, potassium hydroxide, magnesium hydroxide, lithium hydroxide, sodium chloride, potassium chloride, magnesium chloride, hydrochloric acid, sulfuric acid, nitric acid, acetic acid, butyric acid, lactic acid, oxalic acid, myristic acid, and/or perchloric acid.

In some embodiments, the electrolyte of the disclosed photoelectrochemical is in the form of a gel. For example, the electrolyte may be a gel comprising a polymer and an acid.

In some embodiments, the electrolyte is a gel comprising a polymer and an acid, in which the polymer is polyvinyl alcohol, poly(vinyl acetate), poly(vinyl alcohol co-vinyl acetate), poly(methyl methacrylate), poly(vinyl alcohol-co-ethylene ethylene), poly(vinyl butyral-co-vinyl alcohol-co-vinyl acetate), polyvinyl butyral, polyvinyl chloride, polystyrene, or combinations thereof. Suitable polymers for the gel form electrolyte may include others known in the art.

In some embodiments, the electrolyte is a gel comprising a polymer and an acid, in which the acid is acetic acid, propionic acid, hydrochloric acid, hydrofluoric acid, phosphoric acid, sulfuric acid, formic acid, benzoic acid, hydrofluoric acid, nitric acid, phosphoric acid, sulfuric acid, tungstosilicic acid hydrate, hydriodic acid, carboxylic acid, or combinations thereof. Suitable acids for the gel form electrolyte may include others known in the art.

In some embodiments, the cathode of the disclosed photoelectrochemical cell is a nanostructured film.

In some embodiments, the disclosed photoelectrochemical cell is capable of being stable, of being essentially free of photocorrosion, of preventing leakage of solvent, and/or of having low absorption of light.

The disclosed photoelectrochemical cell may produce a photocurrent. In some embodiments, the intensity of a photocurrent produced by the disclosed photoelectrochemical cell is dependent on the concentration of the electrolyte.

The disclosed photoelectrochemical cell may be capable of producing at least 10 times, at least 50 times, at least 100 times, or even at least 200 times difference in stable photocurrent at different applied potentials. In some embodiments, the disclosed photoelectrochemical cell is capable of producing at least a 100 times difference in stable photocurrent at different applied potentials.

2. METHODS

In another aspect, provided is a method of generating hydrogen from water, which comprises providing a photoelectrochemical cell as described herein.

In some embodiments, the photoelectrochemical cell used in the disclosed method comprises ND-RRPHTh blend film as a p-type electrode, $MoS_2$-α-hematite as an n-type electrode, and an acidic or a basic solution.

In some embodiments, the disclosed method further comprises splitting water into hydrogen and oxygen by means of photocurrent from a p-n junction of the electrochemical cell.

The disclosed method of generating hydrogen from water may achieve a photocurrent. In some embodiments, the photocurrent obtained in the disclosed method is at a potential from about 0 V to about 2 V.

In another aspect, provided is a method of producing a photoelectrochemical cell as described herein, which comprises:

(a) Depositing about 1% $MoS_2$-α-$Fe_2O_3$ on a conducting FTO coated glass plate;

(b) Depositing RRPHTH–ND on a silicon or a conducting FTO coated glass plate; and (c) Sandwiching the plate from (a) and the plate from (b) with polyvinyl alcohol (PVA)-hydrochloric acid based gel.

The disclosed RRPHTh–ND electrodes may provide high-sufficiency photoelectrochemical conversion an order of magnitude superior to existing $TiO_2$-RRPHTh and ZnO-RRPHTh nanohybrid films.

In certain embodiments, the disclosed photoelectrochemical cells include $MoS_2$-α-$Fe_2O_3$ as a counter electrode and RRPHTh–ND as a working electrode. With $MoS_2$-α-$Fe_2O_3$ as an n-type electrode and RRPHTh–ND as a p-type electrode, the photoelectrochemical cells may further include a polyvinyl alcohol based gel as a solid electrolyte. In some embodiments, cyclic voltammetry (CV) and chronoamperometry experiments may be performed with visible light simulated for solar radiation and suitable radiation (e.g. 60 W lamp visible light radiation) to determine the photoelectrochemical properties of the disclosed cells.

In some embodiments, the disclosed solid gel based p-n photoelectrochemical cell according may show 100 order magnitude of photocurrent at different applied potentials. Additionally, the disclosed p-n photoelectrochemical cell may be a stable solid state photoelectrochemical cell, which may greatly reduce any photocorrosion, preventing the leakage of solvent. It may also have low absorption of light due to a thin layer of electrolyte.

3. FURTHER ADVANTAGES $MoS_2$ may play an important role for the charge transfer process with slow recombination of electron-hole pairs created due to photo-energy and having the charge transfer rate between surface and electrons.

A particularly advantageous configuration may be of an electrode including $Fe_2O_3$—$MoS_2$ and ND-RRPHTh as electrodes in a photoelectrochemical cell. $MoS_2$-α-$Fe_2O_3$ may be used as a cathode and ND-RRPHTh as an anode in a water based electrolyte including NaOH, HCl, $H_2SO_4$, acetic acid, etc.

Excellent photocurrent may be achieved using α-$Fe_2O_3$-$MoS_2$ND-RRPHTh as electrodes in photoelectrochemical cells or a photovoltaic device using α-hematite $Fe_2O_3$—$MoS_2$/polyvinyl alcohol-HCl-ammonium sulphate (APS)/ND-RRPHTh.

The disclosed photoelectrochemical cells may be essentially free of any silicide material. The electrodes may also be essentially free of phosphate, carbonate, arsenate, phosphite, silicate, and/or borate.

$MoS_2$ particles may promote the electron transport properties of α-$Fe_2O_3$ nanomaterial by doping, homogenous structure, and dependability. The doping of $MoS_2$ particles may vary, for example, from about 0.1%, 0.2%, 0.5%, 1%, 2% to 5% in α-$Fe_2O_3$. The α-$Fe_2O_3$ and $MoS_2$-α-$Fe_2O_3$ nanomaterials may be characterized by X-beam diffraction, SEM, FTIR, Raman spectroscopy, particle analysis, and UV-vis spectroscopy.

A nanodiamond blend with a conducting polymer as a p-type electrode in combination with α-$Fe_2O_3$ may be particularly advantageous.

A metal dichalcogenide may be selected, for example, from $MoS_2$-α-$Fe_2O_3$, tungsten disulfide ($WS_2$)-α-$Fe_2O_3$, molybdenum diselenide ($MoSe_2$)-α-$Fe_2O_3$, molybdenum telluride-α-$Fe_2O_3$, tungsten selenide ($WSe_2$), etc.

A gel electrolyte based on polymer and acid may be selected, for example, from polyvinyl alcohol, poly(vinyl acetate), poly(vinyl alcohol co-vinyl acetate), poly(methyl methacrylate, poly(vinyl alcohol-co-ethylene ethylene), poly(vinyl butyral-co-vinyl alcohol-co-vinyl acetate), polyvinyl butyral, polyvinyl chloride, and polystyrene. The combination of each polymer at different proportions can also be used for making the layer.

Further, the optical range may be increased by using $TiO_2$-α-$Fe_2O_3$ nanostructured film as n-type electrode.

There may be a ten to hundred fold of photo-current p-n junction based in such photoelectrochemical cell for water splitting application.

The photocurrent may be obtained at potential from about 0 to 2,000 V in p-n configuration of electrochemical cell.

As disclosed herein, α-$Fe_2O$—$MoS_2$ electrode was synthesized, and two orders of magnitude of photoelectrochemical properties was measured and 1% $MoS_2$-α-$Fe_2O_3$ shows the stable and nearly two orders of magnitude of stable photocurrent.

The photoelectrochemical photocurrent may be dependent on the concentration of the electrolyte.

One percent $MoS_2$-α-$Fe_2O_3$ deposited on a conducting ITO glass plate and RRPHTH–ND deposited on silicon or conducting FTO glass plates were sandwiched using polyvinyl alcohol (PVA)-hydrochloric acid based gel to fabricate solid gel based photoelectrochemical cell.

The p-n photoelectrochemical cell shows stable solid state photoelectrochemical cell and eliminates the photocorrosion process, prevents the leakage of solvent, and has low absorption of light due to thin layer of electrolyte.

The disclosed photoelectrochemical cells may be essentially free of sensitizers.

3. EXAMPLES

As non-limiting examples of the present technology, disclosed herein are photoelectrochemical cells having $MoS_2$-α-$Fe_2O_3$ as an n-type electrode and regioregular polyhexylthiophene-nanodiamond (RRPHTh–ND) as a p-type electrode. The photoelectrochemical cells may be liquid based or solid based.

Example 1 Molybdenum Disulfide Alpha-Hematite Nanocomposite Films

The nonmetal $MoS_2$ is classified as a two-dimensional (2D) dichalcogenide material with a band gap of about 1.8 eV. It exhibits interesting photocatalytic activity, possibly due to its bonding, chemical composition, doping, and nanoparticle growth on various matrix films, and may also play an important role in charge transfer. As disclosed herein, $MoS_2$ particles may be used to promote electron transport properties of α-$Fe_2O_3$ nanomaterial by doping, homogenous structure, and dependability.

Under this work, $MoS_2$ particles were used to promote electron transport properties of the α-$Fe_2O_3$ nanomaterial by doping and homogenous structure due to $MoS_2$-α-$Fe_2O_3$ nanomaterials. The doping of $MoS_2$ particles varied by 0.1%, 0.2%, 0.5%, 1%, 2% and 5% in α-$Fe_2O_3$. The $MoS_2$-α-$Fe_2O_3$ nanomaterials were characterized using X-ray diffraction, SEM, FTIR, Raman spectroscopy, particle analyzer, and UV-vis techniques. Cyclic voltammetry (CV) and impedance measurements were utilized to understand the electrochemical electrode/electrolyte interface and photoelectrochemical properties of $MoS_2$-α-$Fe_2O_3$ based nanostructures for water splitting applications.

Materials

The materials of iron chloride ($FeCl_3$), aluminum chloride ($AlCl_3$), sodium hydroxide (NaOH), $MoS_2$, and ammonium hydroxide $NH_4OH$ were purchased from commercial sources (Sigma-Aldrich). The fluorine tin oxide (FTO) coated glass with resistance of about 10 Ω/cm$^2$ was also procured from commercial sources (Sigma-Aldrich). The centrifuged containers were purchased to clean the synthesized nanomaterials from the solution.

Experimental Procedure

α-$Fe_2O_3$ and $MoS_2$-α-$Fe_2O_3$ were synthesized by a sol-gel technique as shown in Eq. 1. Table 1 shows the amount of chemicals used for the synthesis of $MoS_2$-α-$Fe_2O_3$. Different concentrations of $FeCl_3$ with $AlCl_3$ were prepared in 500 ml round bottom flasks. NaOH solution was added to the resulting solution and stirred with a magnet for about an hour. A condenser was connected to the round bottom flask, which allowed the chemical reaction to proceed at about 90-100° C. The reaction was terminated after about 24 hours, and the solution was cooled at about room temperature. The synthesized material was separated using a centrifuge and continuous cleaning with water. The synthesized materials (α-$Fe_2O_3$ and $MoS_2$-α-$Fe_2O_3$) were initially left drying at about room temperature. FIG. 1 shows photographs of the materials synthesized using various percentages of $MoS_2$ to α-$Fe_2O_3$. The immediate doping, such as 0.1% $MoS_2$ changes the color of α-$Fe_2O_3$, whereas the dark red color can be visualized with the increase of $MoS_2$ percentage in α-$Fe_2O_3$. The α-$Fe_2O_3$ and $MoS_2$-α-$Fe_2O_3$ were dried at various temperatures (about 100, 200, 300, 400 and 500° C.). In each case, the temperature was maintained in a furnace for about one hour. The materials were collected by cooling at room temperature and kept in a tight bottle for characterization as well as preparation of electrodes for electrochemical and photochemical tests.

Eq. 1

$$FeCl_3{\cdot}6H_2O + MoS_2 \xrightarrow[\text{NaOH (heat 110° C.)/sonination/dry/heat}]{} MoS_2\text{—}Fe_2O_3$$

TABLE 1

The amount of chemical used for synthesis of MoS2-composite α-hematite.

| Chemicals | 0.1% $MoS_2$ w.r.t. $FeCl_3$ | 0.2% $MoS_2$ w.r.t. $FeCl_3$ | 0.5% $MoS_2$ w.r.t. $FeCl_3$ | 1% $MoS_2$ w.r.t. $FeCl_3$ | 2% $MoS_2$ w.r.t $FeCl_3$ | 5% $MoS_2$ w.r.t. $FeCl_3$ |
|---|---|---|---|---|---|---|
| $FeCl_3$ | 6.8 g | 6.8 g | 6.8 g | 6.8 g | 6.8 g | 6.8 g |
| $MoS_2$ | 0.013 g | 0.026 g | 0.065 g | 0.1296 g | 0.2592 g | 0.648 g |
| NaOH | 4.8 g | 4.8 g | 4.8 g | 4.8 g | 4.8 g | 4.8 g |
| $C_{19}H_{42}BrN$ | 0.5 g | 0.5 g | 0.5 g | 0.5 g | 0.5 g | 0.5 g |

Film Formation of the Substrate

The $MoS_2$-α-$Fe_2O_3$ was prepared at different concentrations by mixing with acetic acid to obtain a homogenous solution to cast film on various substrates. About 500 mg of $MoS_2$-α-$Fe_2O_3$ (about 0.1%, 0.2%, 0.5%, 1%, 2%, and 5%) was grinded and then mixed into about 10 ml acetic acid in a small container, and left for about 10 hours. Later, the colloidal solution containing $MoS_2$-α-$Fe_2O_3$ with acetic acid were used to make films on quartz, silicon, and fluorine tin oxide (FTO) coated glass plates. FIG. 1 shows the chemical structure of $MoS_2$-α-$Fe_2O_3$ nanomaterial (right) and photographs of synthesized $MoS_2$-α-$Fe_2O_3$ using different ratios of $MoS_2$ to $Fe_2O_3$, such as about 0.1%, 0.2%, 0.5%, 1%, 2%, and 5%.

The films were cured at different temperatures (about 100, 200, 300, 400 and 500° C.) for about one hour. The XRD, SEM, cyclic voltammetry, and UV-vis characterizations were performed in room temperature cooled $MoS_2$-α-$Fe_2O_3$ films. It has been observed that the nanomaterials treated at 100° C. to 200° C. could still have the water molecules. However, the temperature at around 300° C. allowed to have a solid material. The nanomaterials were further treated to 400° C. and 500° C. In some experiments, passivation, change in structure and morphology were observed in the samples treated at 300° C., 400° C. and 500° C. However, the results are presented for the samples treated at 500° C. due to their enhanced photocurrent.

UV-vis Tests

FIG. 2 shows UV-vis spectra of α-$Fe_2O_3$, $MoS_2$ and α-$Fe_2O_3$—$MoS_2$-prepared at a different ratio of $MoS_2$ to α-$Fe_2O_3$. An UV-vis Spectrometer Jasco V-530 was used to measure the absorption spectra on various samples deposited on glass plates. FIG. 2A shows the UV-vis absorption at about 550 nm for pristine α-$Fe_2O_3$, as known in the art. FIG. 2B shows the characteristics absorption bands of about 388, 453, 618, and 679 nm for the $MoS_2$ nanomaterial film on glass plates. FIGS. 2C-2F show the UV-vis absorption spectra for $MoS_2$ doped in different percentages (about 0.1%, 0.2%, 1%, and 5%) with α-$Fe_2O_3$ nanomaterial. FIG. 2C shows the absorption bands at about 282, 454, and 463 nm. FIG. 2D shows the absorption bands at about 446 and 565 nm. The distinct peaks can be seen at about 382, 461, and 570 nm. FIG. 2E shows the UV-vis bands at about 382, 456, and 559 nm, whereas FIG. 2F shows the absorption bands at about 382, 459, and 572 nm. There is a blue shift with an increase of $MoS_2$ in α-hematite. However, the band observed for 0.1% $MoS_2$ doping is shifted at about 572 nm in 5% $MoS_2$ doping in α-$Fe_2O_3$ nanomaterial. Such a result is consistent with the results shown for transition composite metal ions. The UV-vis spectra of the composite hematite have been estimated to be about 2.17 eV for the band at about 572 nm.

XRD Tests

Figure 3:
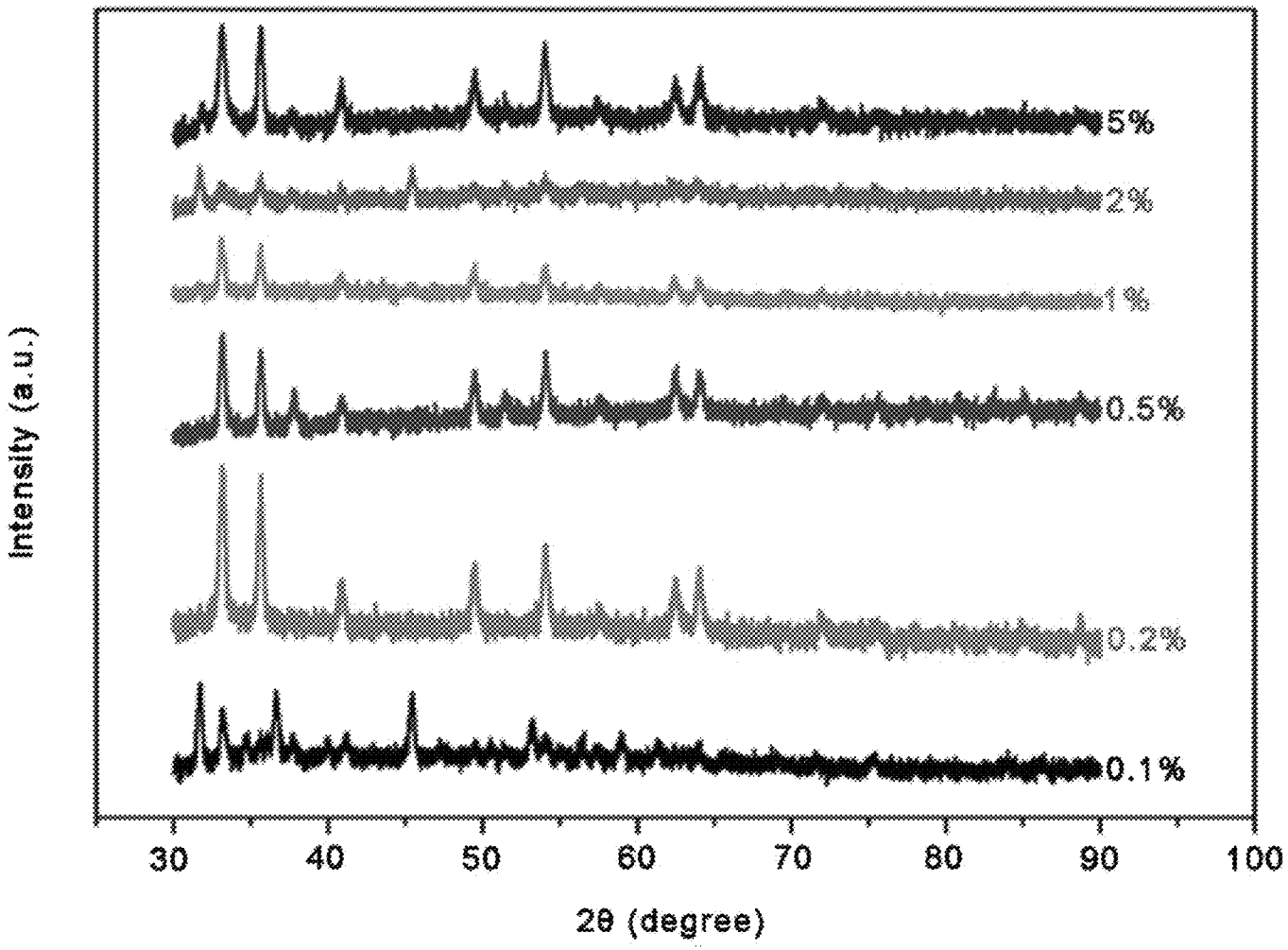
FIG. 3 shows powder X-ray diffraction patterns of $MoS_2$ with $\alpha$-$Fe_2O_3$ nanocomposite.

The crystalline structure of $MoS_2$-α-$Fe_2O_3$-nanocomposite was investigated by using Powder X-ray diffraction (XRD), model PANalytical X'Pert Pro MRD system with Cu Kα radiation (wavelength=1.5442 Å) operated at 40 kV and 40 mA. FIG. 3 shows X-ray diffraction curves for different percentages of $MoS_2$ (about 0.1%, 0.2%, 0.5%, 1%, 2%, and 5%) to α-$Fe_2O_3$. α-$Fe_2O_3$ has a polycrystalline structure as known from the XRD pattern. The diffraction common peaks of $MoS_2$-α-$Fe_2O_3$ nanocomposite with different percentages of $MoS_2$ shows at 31.2°, 33.2°, 37.5°, 40.9°, 49.5°, 54.1°, 62.2°, and 64.2°, which can be indexed to (012), (104), (110), (113), (024), (116), (214), and (300) crystal planes of hexagonal iron oxide. It is clear from strong and sharp diffraction peaks that α-$Fe_2O_3$ is well crystallized in the synthesis process for all percentage of $MoS_2$ in α-$Fe_2O_3$. The peak at 54.1° may be due to the presence of $MoS_2$ in the structure in $MoS_2$-α-$Fe_2O_3$-nanocomposite.

FTIR Studies

Figure 4:
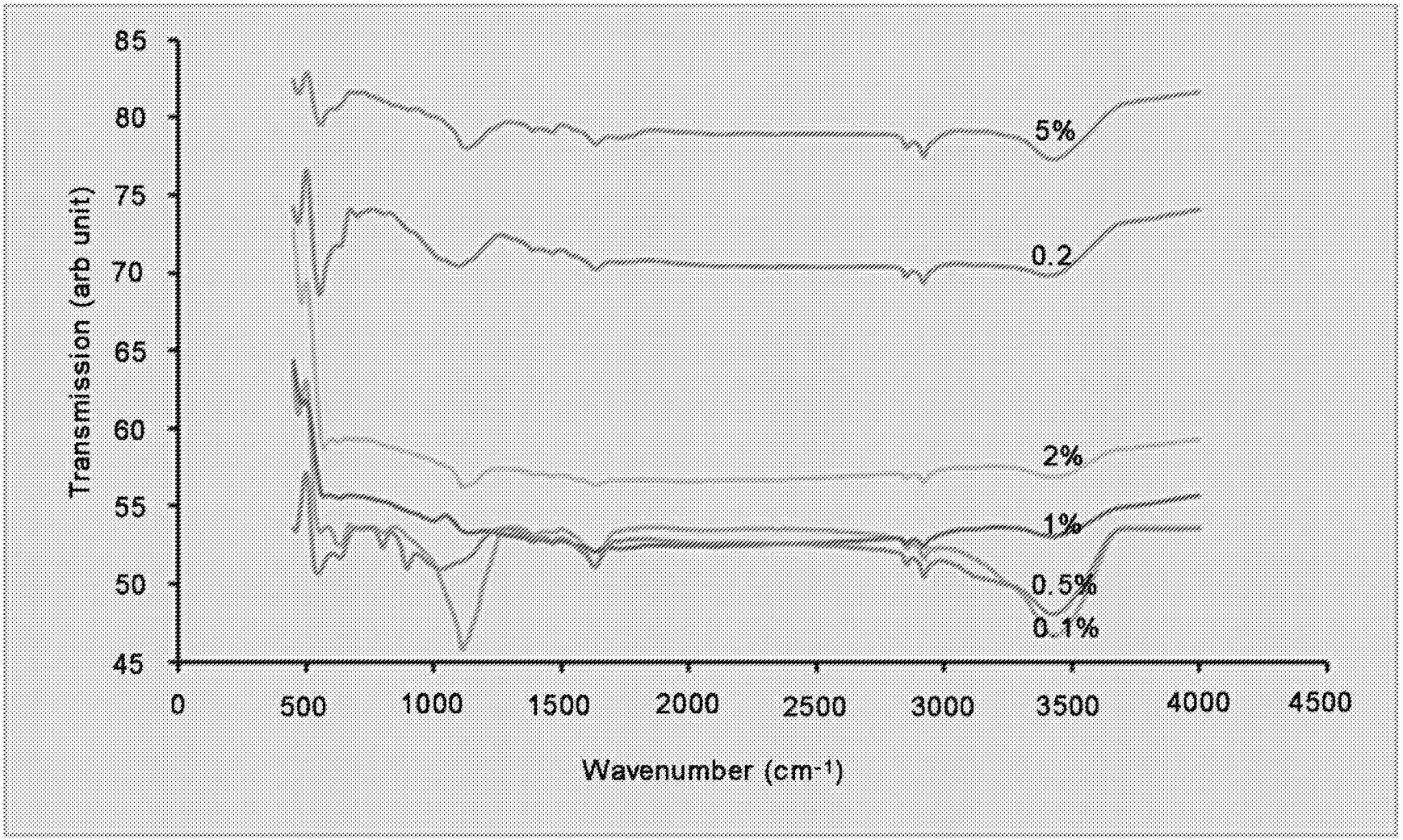
FIG. 4 shows FTIR spectra of $MoS_2$ with $\alpha$-hematite nanocomposite. Each curve $MoS_2$ doping with $Fe_2O_3$ is given as: Curve 1=5% $MoS_2$, Curve 2=0.2% $MoS_2$—$Fe_2O_3$, Curve 3=2% $MoS_2$—$Fe_2O_3$, Curve 4=1% $MoS_2$—$Fe_2O_3$, Curve 5=0.5% $MoS_2$—$Fe_2O_3$ and Curve 6=0.1% $MoS_2$—$Fe_2O_3$.

A Perkin Elmer spectrum one was utilized to study FTIR spectroscopy of various samples of $MoS_2$-α-$Fe_2O_3$-nanocomposite. The $MoS_2$-α-$Fe_2O_3$-nanocomposite was mixed with KBr, the pellets were made using the hydraulic press, and the samples were measured using the transmission mode from 400 to 4000 $cm^{-1}$. FTIR spectra of $MoS_2$-α-$Fe_2O_3$ shows the change of percentage of $MoS_2$ doping with α-$Fe_2O_3$ with Curve 1% to 5%, Curve 2% to 0.2%, Curve 3% to 2%, Curve 4 to 1%, Curve 5% to 0.5%, and Curve 6% to 0.1% of $MoS_2$ in $MoS_2$-α-$Fe_2O_3$ in shown in FIG. 4. The infrared bands of each $MoS_2$ doping to α-$Fe_2O_3$ are shown in Table 2.

TABLE 2

The Infrared bands of each $MoS_2$ doping to α-$Fe_2O_3$.

| $MoS_2$ | Wavenumber ($cm^{-1}$) |
|---|---|
| 5% | 474, 562, 620, 1136, 1193, 1472, 1642, 2858, 2924, 3436 |
| 2% | 484, 562, 620, 1136, 1193, 1472, 1642, 2858, 2924, 3436 |
| 1% | 474, 570, 640, 1006, 1134, 1388, 1470, 1670, 2854, 2924, 3436 |
| 0.5% | 458, 554, 644, 802, 898, 1042, 1386, 1468, 1634, 2856, 2922, 3438 |
| 0.1% | 512, 522, 654, 802, 1114, 1396,1434, 1666, 2836, 2952, 3448 |

The hydroxyl (OH) group in α-$Fe_2O_3$ is related to infrared band at 3414 $cm^{-1}$. The band at 1642 $cm^{-1}$ is due to v (OH) stretching. The band at 562 $cm^{-1}$ is due to Fe—O vibration mode in $Fe_2O^3$. The band at 620-654 and 474-512 are related to the lattice defects in $Fe_2O_3$. The infrared band at 474-512 $cm^{-1}$ is due to stretching vibration depicting the presence of $MoS_2$ in the MoS2-α-$Fe_2O_3$ structure. The doping of 0.1% to 5% of $MoS_2$ shifts the infrared band from 512 $cm^{-1}$ to 474 $cm^{-1}$. The band at 474 $cm^{-1}$ is the band observed for exfoliated $MoS_2$ nanosheets revealing that maximum doping in $MoS_2$-α-$Fe_2O_3$ structure.

SEM Tests

Figure 5:
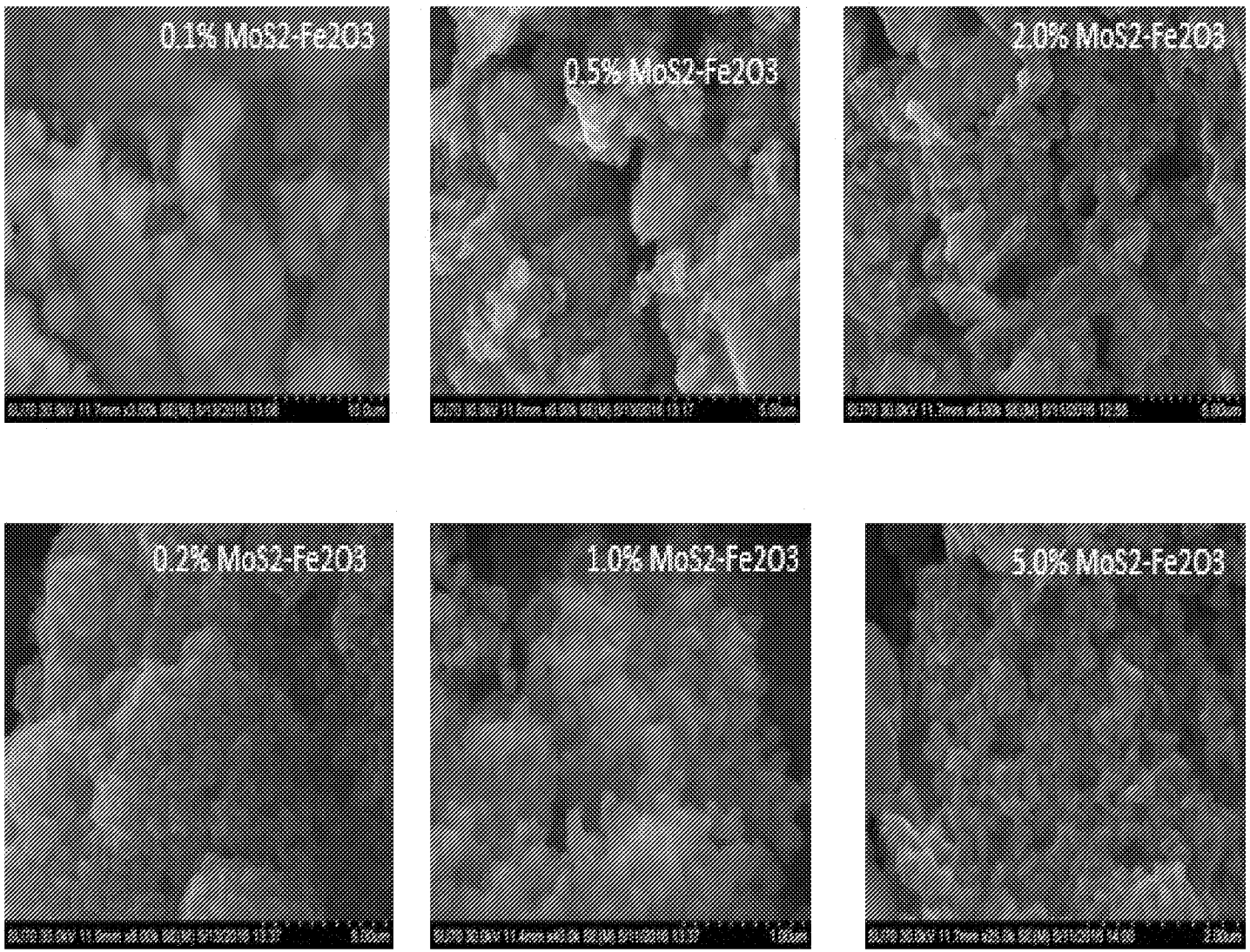
FIG. 5 shows scanning electron micrographs (SEM) of $MoS_2$ with $\alpha$-$Fe_2O_3$ nanocomposite.

The scanning electron microscopy (SEM) of various $MoS_2$-α-$Fe_2O_3$ samples were measured using FE-SEM, S-800, Hitachi. FIG. 5 shows SEM images of $MoS_2$-α-$Fe_2O_3$ nanomaterials, which comprised different percentages, from 0.1% to 5% $MoS_2$ to $Fe_2O_3$ in $MoS_2$-α-$Fe_2O_3$. SEM images show morphology of blooming flower-like nanoparticles with $MoS_2$ doping in $MoS_2$-α-$Fe_2O_3$ for $MoS_2$-α-$Fe_2O_3$ structure. The images reveal that the size of the particle changes for the increase of $MoS_2$ doping from 0.1% to 5% in $MoS_2$-α-$Fe_2O_3$ nanomaterial. It is difficult to recognize simple α-$Fe_2O_3$ nanoparticles from $MoS_2$ nanosheets, meaning a strong interface formation between α-$Fe_2O_3$ and $MoS_2$ in $MoS_2$-α-$Fe_2O_3$ nanomaterial.

Raman Spectroscopy

Figure 6A:
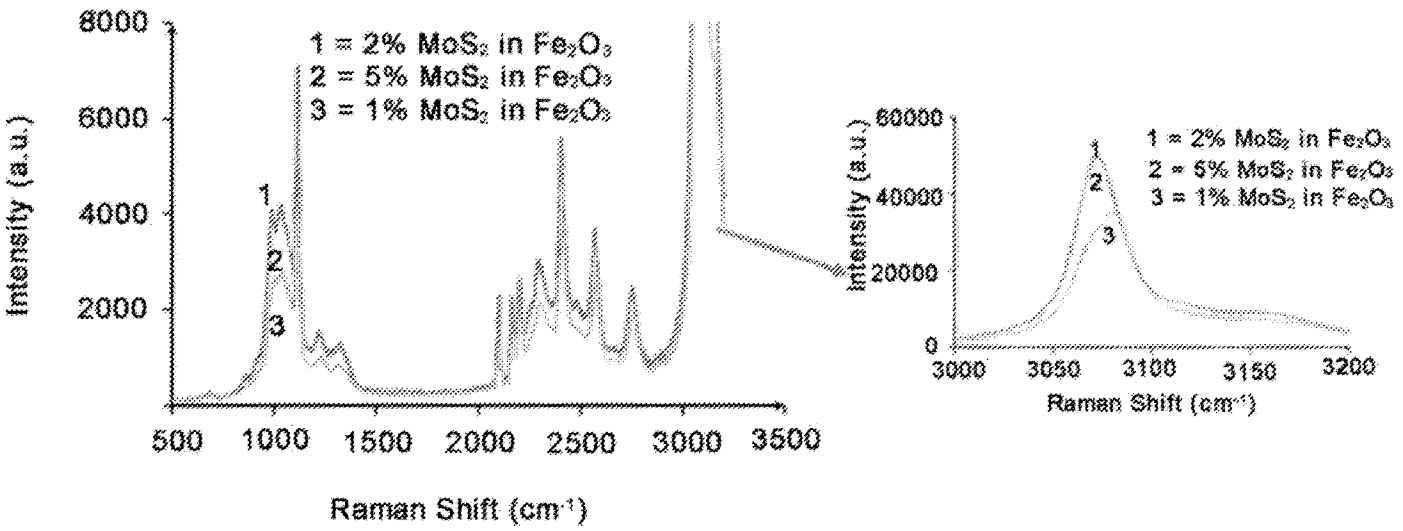
FIGS. 6A and 6B show Raman spectra of $MoS_2$-$\alpha$-$Fe_2O_3$ film sample and ITO substrate as various percentage of $MoS_2$.
Figure 6B:
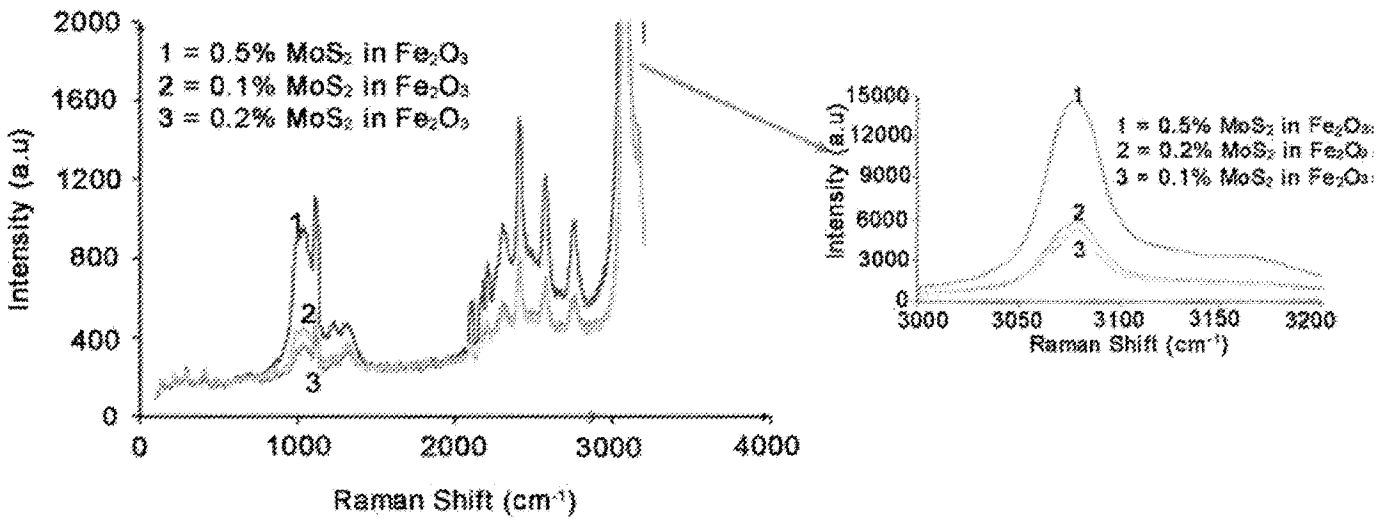

The Raman spectrum is measured which is also a rapid and nondestructive surface characterization technique to probe the vibrational properties of bonding of $MoS_2$ to $Fe_2O_3$ in $MoS_2$-α-$Fe_2O_3$ nanomaterial. FIGS. 6A and 6B show the Raman spectra of $MoS_2$-α-$Fe_2O_3$ film excited by 532 nm laser. The Raman shift at 532 $cm^{-1}$ resonates with the electronic transition in ring structures for aromatic clustering processes in sp2-dominated particles. The shift associated at 374 and 417 $cm^{-1}$ are due to in-plane vibrational ($E_{2g1}$) and the out-of-plane vibrational ($A_{1g}$) modes. The enhanced $MoS_2$ is indicative of energy difference between Raman shifts due to $MoS_2$ content in $MoS_2$-α-$Fe_2O_3$ nanomaterial.

Particle Analysis

Figure 7:
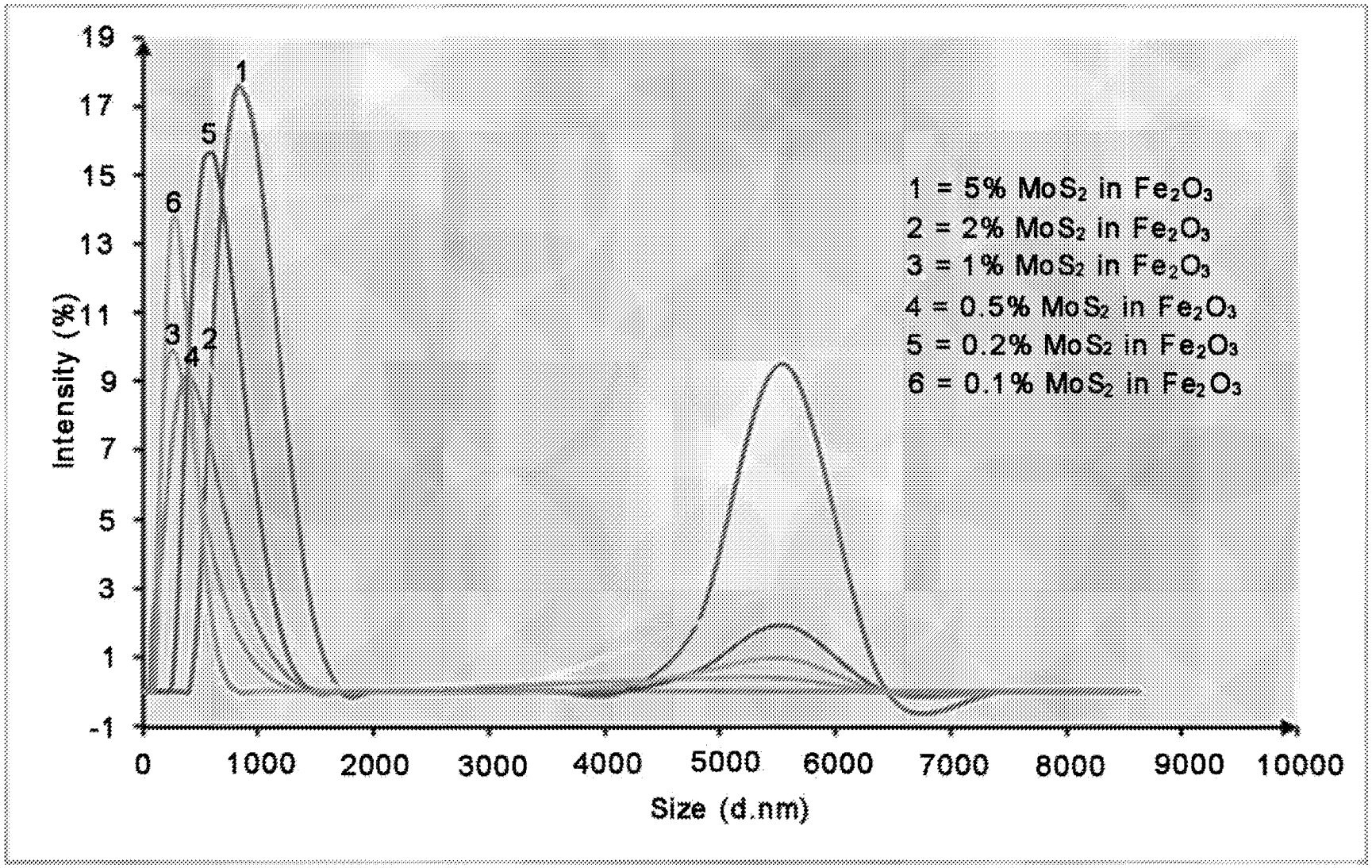
FIG. 7 shows the particle size measurement of $MoS_2$-$\alpha$-$Fe_2O_3$ nanocomposite materials as a function of $MoS_2$ dopant.

The Zetasizer Nano particle analyzer range model was used to measure the average particle size of various $MoS_2$-α-$Fe_2O_3$ samples. Initially, the $MoS_2$-α-$Fe_2O_3$ nanomaterial was dispersed in water and ultra-sonicated to have aggregated free colloidal sample. FIG. 7 shows the particle size of $MoS_2$-α-$Fe_2O_3$ as a function of $MoS_2$ doping in α-$Fe_2O_3$. The average particle size in liquid sample ranges from 459 nm (0.1%) to 825 nm for (5%) dopant of MoS2 respectively. Although these particles are small, there are few particles which are larger than 5 microns. These larger particles that can be detected through SEM measurement are a result of aggregation. The average size of particles is important for the fabrication of the electrodes from the particles. This information of nanomaterial dispersion of MoS2-α-Fe2O3 can be exploited for the electrode fabrication or other applications.

Cyclic Voltammetry

Figure 8:
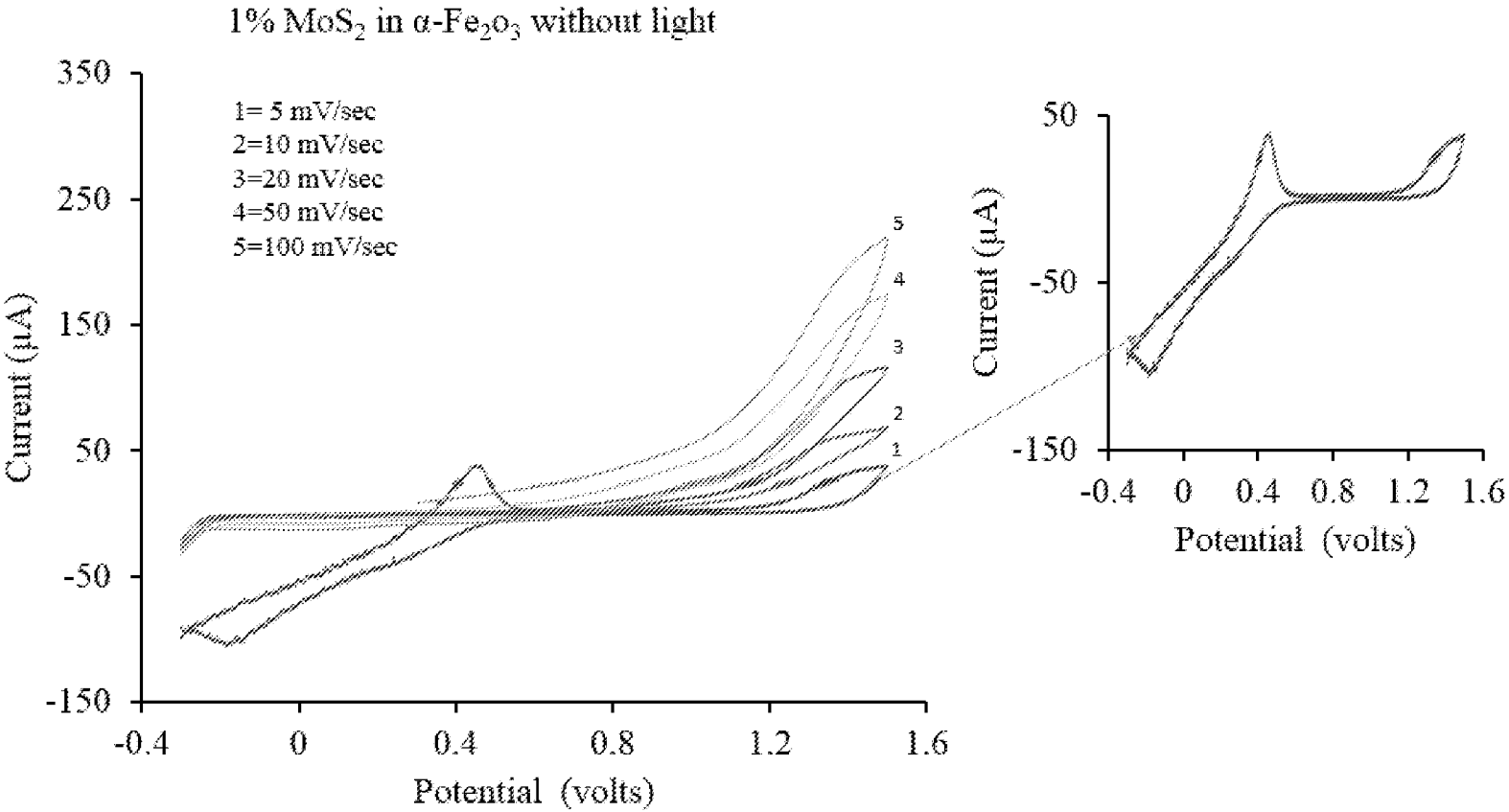
FIG. 8 shows cyclic voltammetry of about 1% $MoS_2$ with $Fe_2O_3$ nanocomposite without light in about 1 M NaOH.

The electrochemical measurements on various $MoS_2$-α-$Fe_2O_3$ electrodes were measured from electrochemical workstation (Volta lab). The electrochemical set-up was adopted similar to earlier studies on hybrid films. FIG. 8 shows the cyclic voltammetry (CV) of 1% $MoS_2$-α-$Fe_2O_3$ in about 1 M NaOH as a working electrode, platinum (Pt) as a reference, and Ag/AgCl as reference electrode in three electrode based electrochemical cells. The continuous increase of CV current is observed with an increase in function of scan rate. The presence of $MoS_2$ ions induces the electrochemical properties and about 1.3V can be sees as the oxidation potential of water, which is less than the Al-doped material.

Figure 9:
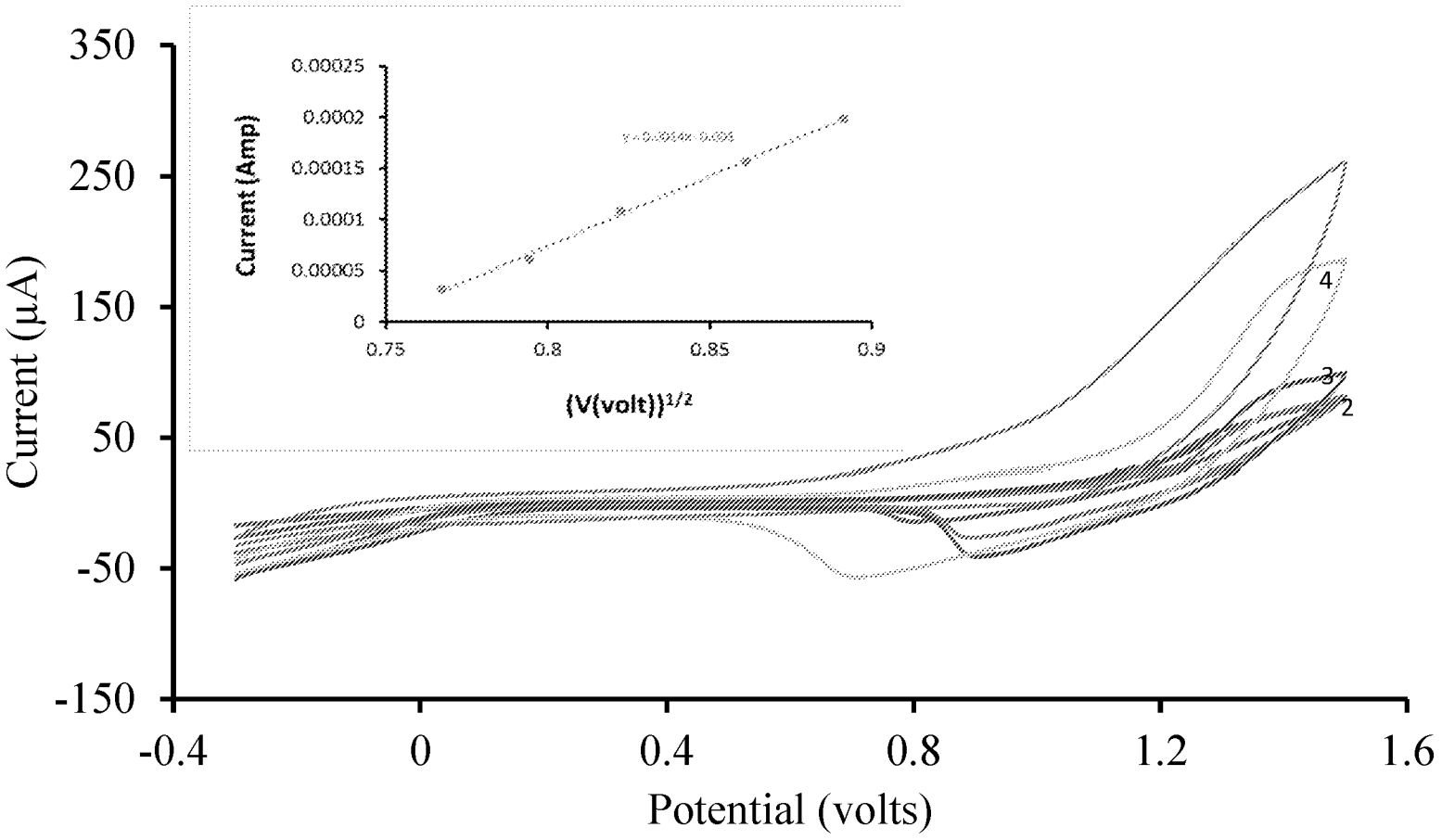
FIG. 9 shows cyclic voltammetry of about 1% $MoS_2$ with $Fe_2O_3$ nanocomposite with light in about 1 M NaOH.

The CV is shown in FIG. 9 with application of light simulated for solar radiation. However, at the scan rate of about 100 mV/sec, there is a maximum photocurrent absorbed for $MoS_2$-α-$Fe_2O_3$ film. The diffusion coefficient has been calculated using peak current for a reversible cyclic voltammetry is given by the Randles-Sevcik equation (Eq. 2). The diffusion coefficient has been estimated to be $0.24\times10^{-16}$ $cm^2$/sec.

$$I_p=(2.69\times10^5)n^{3/2}ACD^{1/2}v^{1/2} \quad \text{Eq. 2}$$

where $I_p$ is current, n is number of electrons, A is electrode area ($cm^2$), C is concentration ($mol/cm^3$), D is diffusion coefficient ($cm^2/s$), and v is potential scan rate (V/s).

Chronoamperometry Tests

Figure 10A:
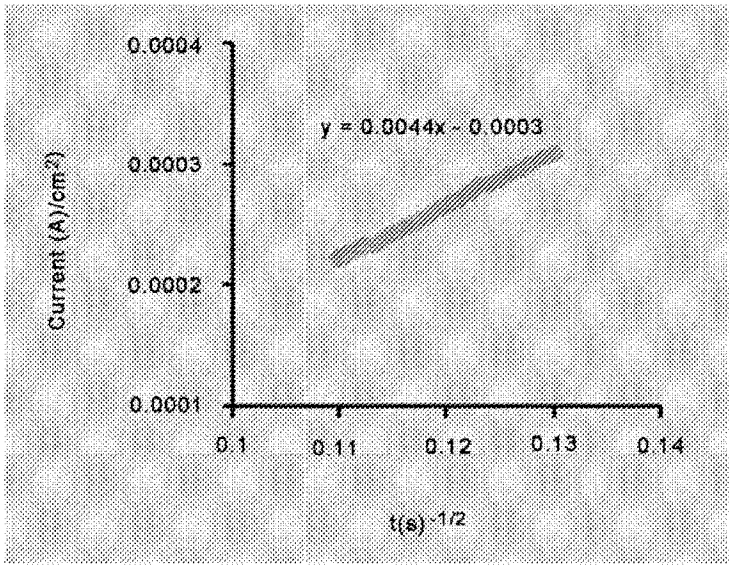
FIGS. 10A and 10B show the chronoamperometry photocurrent plots with $t(s)^{-1/2}$ for oxidation and reduction processes for $MoS_2$-$\alpha$-$Fe_2O_3$ film.
Figure 10B:
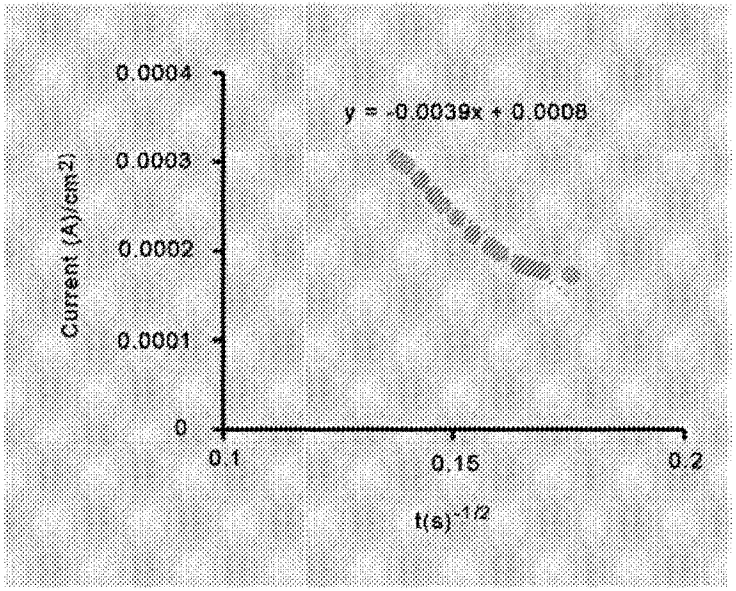

In some studies, $MoS_2$-α-$Fe_2O_3$ film was deposited on ITO coated glass substrates uniformly using the homogenous paste obtained using acetic acid. The thickness of $MoS_2$-α-$Fe_2O_3$ was around 30 μm. FIGS. 10A and 10B show the chronoamperometry tests of two electrodes cell consisting of $MoS_2$-α-$Fe_2O_3$ film as working and steel as counter in various concentrations (about 0.01, 0.1, and 1 M) of NaOH based electrolyte. The potential from about −1,000 mV to about 1,500 mV was applied, and the chronoamperometry photocurrent was studied. FIGS. 10A and 10B show the chronoamperometry photocurrent plot with $t^{-1/2}$ for oxidation and reduction processes for $MoS_2$-α-$Fe_2O_3$ film. The rise of photocurrent shows $t^{-1/2}$ linear with excitation of light. The current transient is different from the excitation of light. The diffusion-controlled photocurrent is calculated using the Cottrell equation in Eq. 3.

$$i=[nFAD^{1/2}C]/[\pi t^{1/2}] \quad \text{Eq 3}$$

where n is the electron participating in the reaction, F is the faraday constant, A is the area of the electrode, i is the transient current, D is the diffusion coefficient, and C is the concentration of the electrolyte. D was estimated to be $1.057\times10^{-14}$ $cm^2$/sec.

Impedance Study

Figure 11A:
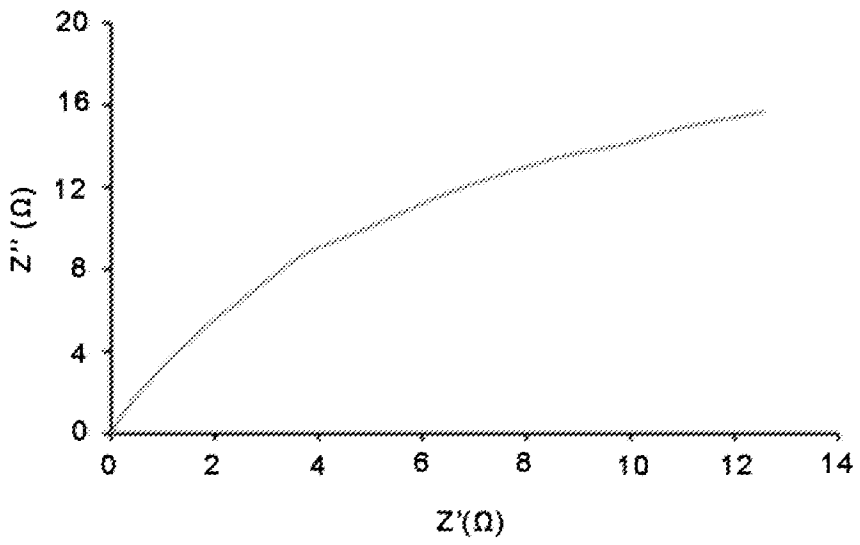
FIGS. 11A and 11B show Nyquist plots of $MoS_2$-$\alpha$-$Fe_2O_3$ film in 1 M HCl in photoelectrochemical cell without (FIG. 11A) and with (FIG. 11B) light irradiation.
Figure 11B:
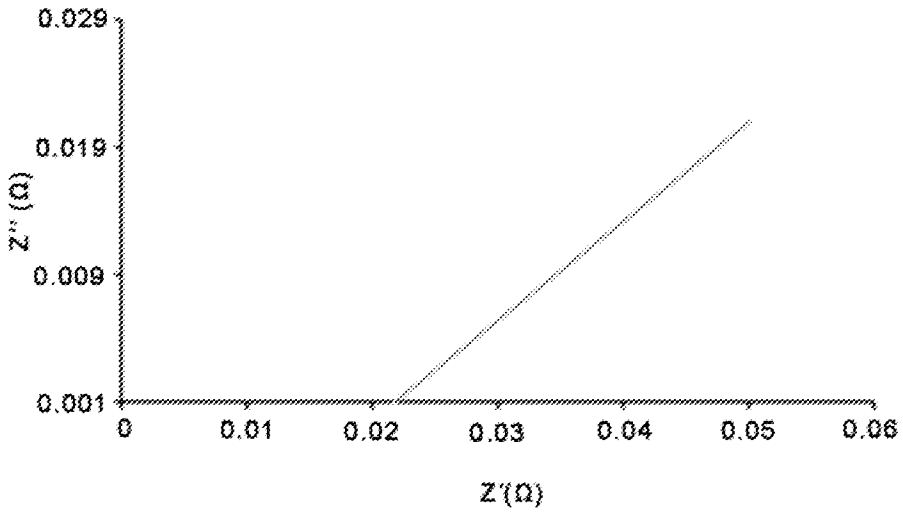
Figure 12:
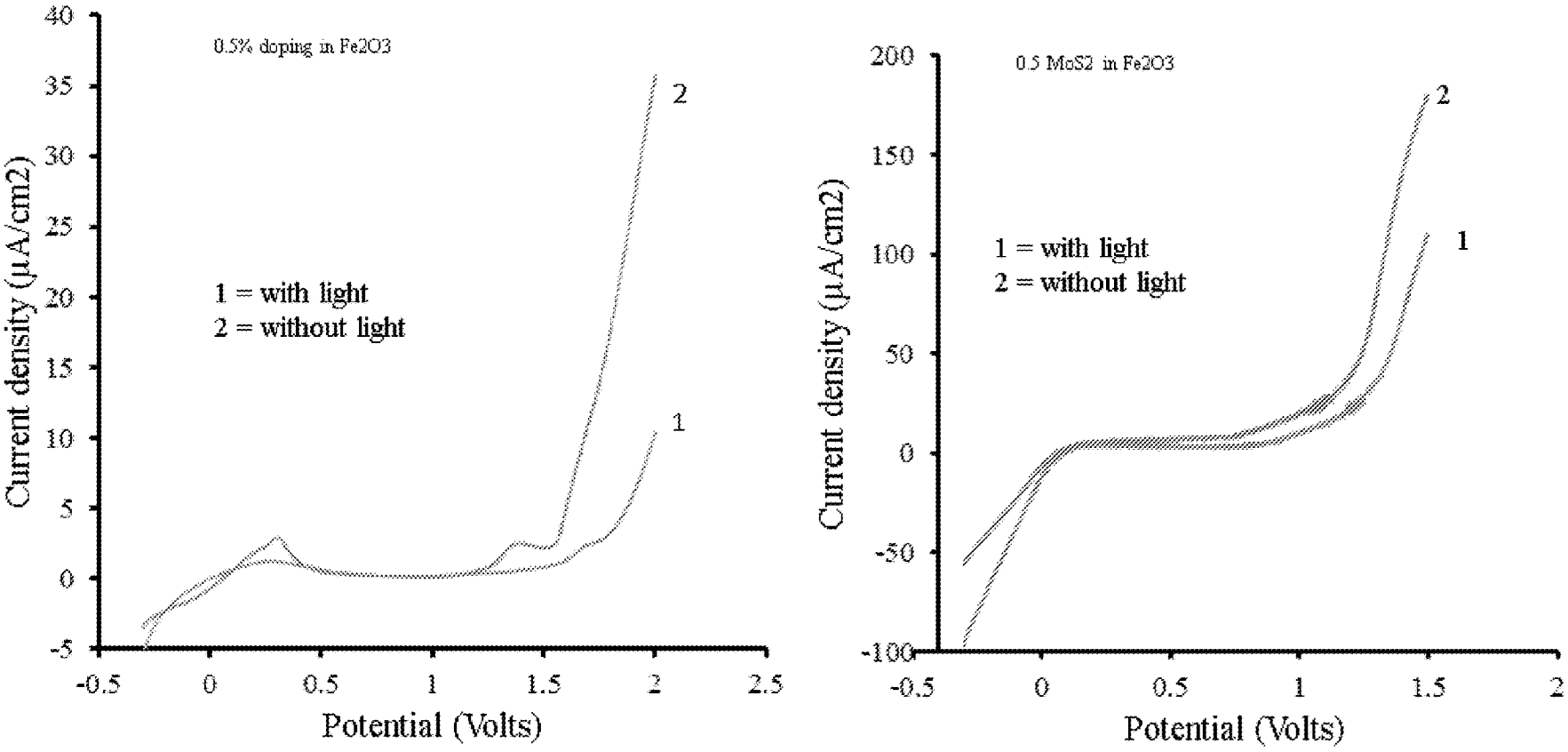
FIG. 12 shows half sweep potential with and without light for Al doped-$\alpha$-$Fe_2O_3$ and for $MoS_2$-$\alpha$-$Fe_2O_3$ film.

FIGS. 11A and 11B show the Nyquist plot in 1 M NaOH without and with light irradiation in $MoS_2$-α-$Fe_2O_3$ film in a photoelectrochemical set-up. The change in the impedance value has been observed for real and imaginary without light irradiation as shown in FIGS. 11A and 11B. The photocurrent is able to make process more conducting in presence of light.

Half Sweep Potential

FIG. 10 shows the half sweep potential with and without light for both Al doped-α-$Fe_2O_3$ and $MoS_2$-α-$Fe_2O_3$. Aluminum doping has shown the photocurrent to 35 μA whereas for the same type of electrode for $MoS_2$-α-$Fe_2O_3$ shows the current till 150 μA. Besides Schottky type current-voltage is experienced for both aluminum doped as well as $MoS_2$-α-$Fe_2O_3$ based electrode in photoelectrochemical cell.

Schematic of $MoS_2$-α-$Fe_2O_3$ Reaction Process

Figure 13:
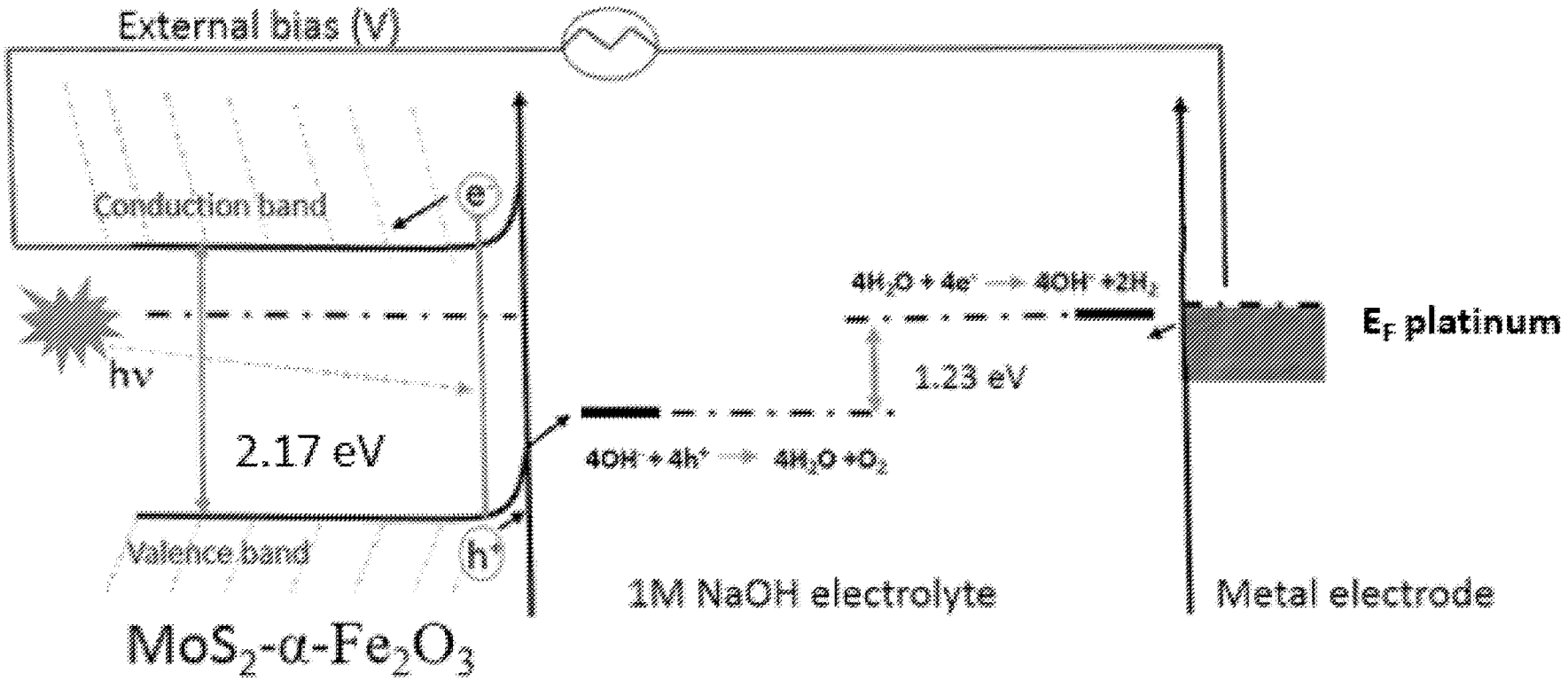
FIG. 13 shows a schematic of hydrogen production using $MoS_2$-composite $\alpha$-$Fe_2O_3$ photocatalyst in about 1 M NaOH.

A schematic was drawn to understand the effect of $MoS_2$ with α-$Fe_2O_3$. The schematic of hydrogen production using $MoS_2$-composite α-$Fe_2O_3$ photocatalyst in about 1 M NaOH is shown in FIG. 13. The band gap of $MoS_2$ varied from about 1.2-1.9 eV, whereas the band gap of $Fe_2O_3$ is about 2.1 eV. The estimated band gap of $MoS_2$-composite α-$Fe_2O_3$ in range of about 1.94 to 2.40 eV based on UV-vis measurements, which is well in the region of visible light. $MoS_2$ doping also increases the conductivity of the samples. The schematic in FIG. 13 shows the photogenerated electrons from conduction band of $MoS_2$ is transferred to conduction band (CB) of hematite whereas holes from hematite are transferred to valence band (VB) of $MoS_2$. This may enhance the photocatalytic activity of $MoS_2$ composite with $Fe_2O_3$ in $MoS_2$-α-$Fe_2O_3$ nanomaterial based electrode.

Thus, the synthesized $MoS_2$-α-$Fe_2O_3$ observed the shift in the band gap to 2.17 eV with $MoS_2$ doping. There is a marked change in the band due to $MoS_2$ doping in α-$Fe_2O_3$. The increase of $MoS_2$ dominated the structure as marked from SEM measurements. The photocurrent can be clearly distinguishable with and without light irradiation through various electrochemical studies on $MoS_2$-α-$Fe_2O_3$ nanomaterial. The enhanced photocurrent is observed with $MoS_2$ doping in $MoS_2$-α-$Fe_2O_3$ nanomaterial. The $MoS_2$-α-$Fe_2O_3$ nanomaterial thin film has the potential to produce hydrogen using a PEC water splitting process that could have renewable energy applications. These results may enable the use of $MoS_2$-α-$Fe_2O_3$ as n-type in p-n photoelectrochemical studies for efficient water splitting applications.

Example 2 p-n Photoelectrochemical Cell Using α-Hematite-Molybdenum Disulfide as n-Electrode and Polyhexylthiophene (RRPHTh)—Nanodiamond (ND) as p-Electrode The recent momentum in energy research has simplified converting solar to electrical energy through photoelectrochemical (PEC) cells which can be closely compared to p-n junction solar cells. The PEC cells have numerous benefits, such as the inexpensive fabrication of thin film, reduction in absorption losses, due to transparent electrolyte, and a substantial increase in the energy conversion efficiency compared to the p-n junction based solar cells. Enhanced photocatalytic activity has been shown using molybdenum disulfide ($MoS_2$) doped alpha (α)-hematite ($Fe_2O_3$) over α-$Fe_2O_3$ nanomaterials, due to the materials its bonding, chemical composition, doping and nanoparticles growth on the graphene films. The photoelectrochemical properties of p-n junction of PEC cell using polyhexylthiophene (RRPHTh) conducting polymer and nanodiamond (ND) as p-type and $MoS_2$-α-$Fe_2O_3$ nanocomposite films as n-type electrode materials were explored.

The α-$Fe_2O_3$—$MoS_2$ nanocomposite material was synthesized using sol-gel technique, and characterized using SEM, X-ray diffraction, UV-vis, FTIR and Raman techniques, respectively. The other electrode nanomaterial as ND-RRPHTh was synthesized using reported method (Ram et al., The Journal of Physical Chemistry C, 2011. 115(44): p. 21987-21995). The electrochemical techniques were utilized to understand the photocurrent, electrode and the electrolyte interface of α-$Fe_2O_3$—$MoS_2$ and ND-RRPHTh nanocomposite films. The photoelectrochemical properties of p-n junction of $MoS_2$-α-$Fe_2O$-ND-RRPHTh, deposited on either n-type silicon or FTO-coated glass plates, showed 3-4 times higher in current density and energy conversion efficiencies than parent electrode materials in an electrolyte of 1M of NaOH in PEC cells. Nanomaterials based electrode α-$Fe_2O_3$—$MoS_2$ and ND-RRPHTh have shown an improved hydrogen release compared to α-$Fe_2O_3$, aluminum α-$Fe_2O_3$ and $MoS_2$ doped α-$Fe_2O_3$ nanostructured films in PEC cells.

Nano-hybrid RRPHTh with various dopant ($TiO_2$, ZnO, and nanodiamond) has previously been used for photoelectrochemical applications. RRPHTh-nanodiamond (ND) electrode has been used to provide high-sufficiency photoelectrochemical conversions superior to $TiO_2$-RRPHTh and ZnO-RRPHTh nanohybrid film (U.S. Pat. No. 9,416,456, which is incorporated herein by reference). Here, the use of $MoS_2$-α-$Fe_2O_3$ as n-electrode and RRPHTh–ND as p-electrode in liquid-based photoelectrochemical cells was studied in PEC cells. $MoS_2$-α-$Fe_2O_3$, as counter electrode, and RRPHTh–ND, as a working electrode, were used to study the photoelectrochemical cells. The CV, chronoamperometry studies were performed with visible light, radiation simulated for solar radiation as well as with 60 W lamps, to understand the photoelectrochemical properties of PEC cells.

Materials

The materials iron chloride ($FeCl_3$), aluminum chloride ($AlCl_3$), sodium hydroxide (NaOH), $MoS_2$, poly(3-Hexylthiophene) and ammonium hydroxide ($NH_4OH$) were purchased from Sigma-Aldrich. The fluorine tin oxide (FTO) coated glass, with resistance of ~10Ω, was also procured from Sigma-Aldrich. The centrifuged containers were purchased to clean the synthesized nanomaterials from the solution.

Synthesis of Nanomaterials

The α-$Fe_2O_3$ and $MoS_2$-α-$Fe_2O_3$ were synthesized by a sol-gel technique. Different concentrations of $FeCl_3$ with $AlCl_3$ were prepared in 500 ml round bottom flasks. Later, NaOH was added to the resulting solution and stirred with a magnet. A condenser was connected to the round bottom flask, containing the chemicals, then placed in a heater to maintain 90-100° C. for the chemical reaction. The reaction was terminated after 24 hours, and the solution was cooled at room temperature. The synthesized material was separated using a centrifuge and continuous cleaning with water. The synthesized materials ($MoS_2$-α-$Fe_2O_3$) were initially left drying at room temperature. The $MoS_2$-α-$Fe_2O_3$ was then dried at various temperatures (100, 200, 300, 400 and 500° C.). In each case, the temperature was maintained in a furnace for one hour. The materials were then brought to room temperature, and collected in a tight bottle for photoelectrochemical and various physical characterization studies.

Film Formation of Substrate

The $MoS_2$-α-$Fe_2O_3$ was prepared at different concentrations by mixing it with acetic acid to obtain a homogenous solution to cast on various substrates. 500 mg of $MoS_2$-α-$Fe_2O_3$ (0.1%, 0.2%, 0.5%, 1%, 2% and 5%) was ground into a powder and then mixed into 10 ml acetic acid in a small container and left for 10 hours. Later, the solutions were used to make films on quartz, silicon and fluorine tin oxide (FTO). The films were cured at different temperatures (300, 400 and 500° C.) for one hour. The films were cooled to room temperature and used for XRD, SEM, cyclic voltammetry and UV-vis measurements.

RRPHTH–ND/NaOH/$Fe_2O_3$-ND Based Photoelectrochemical Cell

Figure 23A:
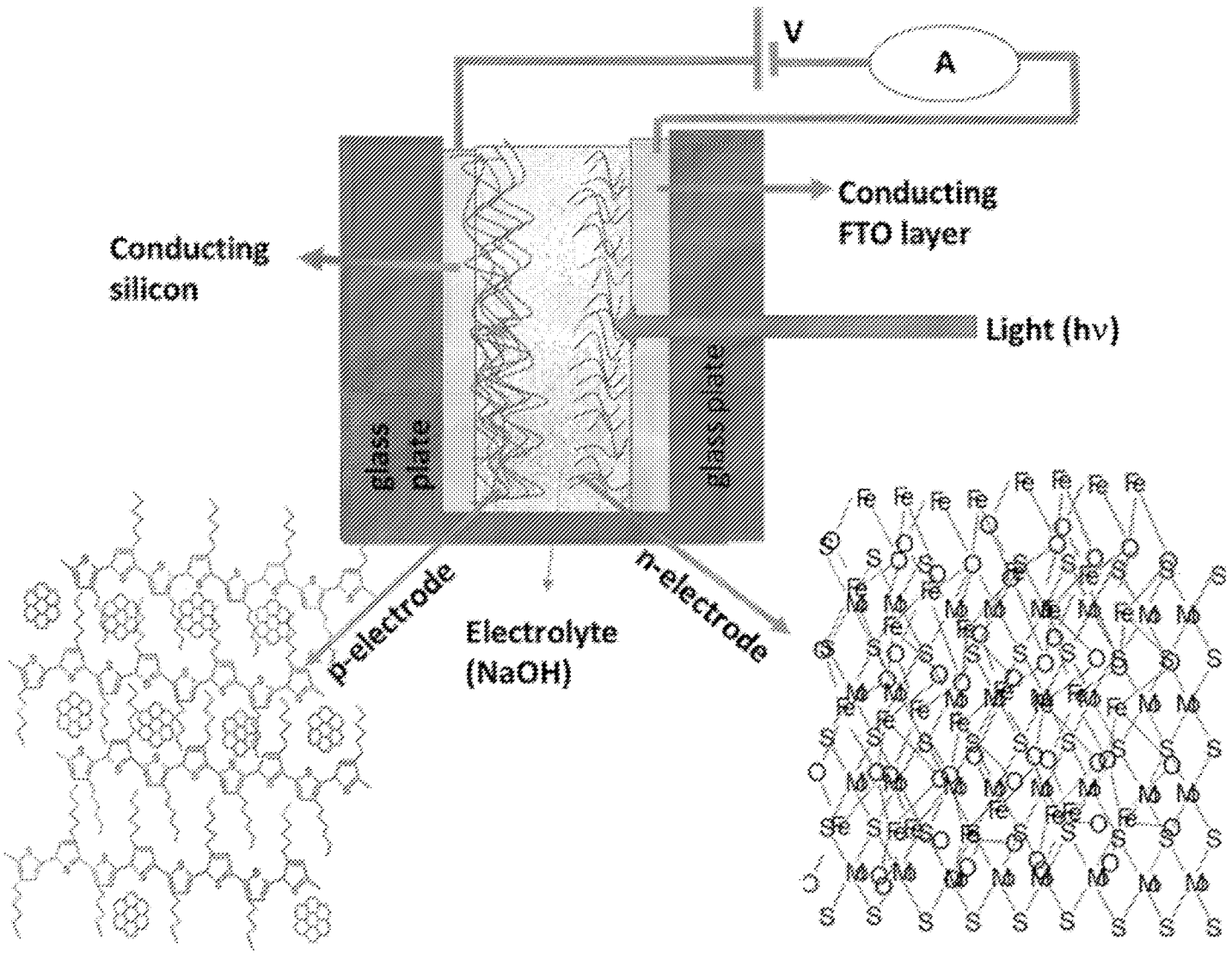
FIG. 23A shows a schematic of hydrogen production using $MoS_2$-composite $\alpha$-$Fe_2O_3$ as n-type and RRPHTh+ND as p-type photocatalyst in 1 M NaOH.

The conducting polymer solution was made by dissolving about 50 mg of RRPHTH in about 50 ml of chloroform. Later, about 50 mg of nanodiamond (ND) was added to the solution and kept stirring for about 24 hours. The RRPHTH–ND film was fabricated using spin coating as well as by casting the solution on silicon and ITO coated glass substrates. The photoelectrochemical cell was constructed using silicon as well as ITO coated RRPHTh–ND as the working electrode and $MoS_2$—$Fe_2O_3$ as the counter electrode. The cyclic voltammetry (CV) as well as the chronoamperometry measurements were made using 0.1 M and 1M NaOH concentration. FIG. 23A shows the schematic of hydrogen production using $MoS_2$-composite α-$Fe_2O_3$ photocatalyst in 1 M NaOH based electrolyte in a PEC cell.

SEM

The structure and surface properties of α-$Fe_2O_3$, $MoS_2$-α-$Fe_2O_3$ and RRPHTh+ND films on silicon substrates were investigated through Field Emission Hitachi 5800 Scanning Electron Microscope (SEM) with EDS attachment which, worked at 25 kV. FIG. 14A shows SEM image of α-$Fe_2O_3$ nanomaterial consisting of well-dispersed spheres with particle sizes of 100-300 nm. The particle sizes have increased in $MoS_2$-α-$Fe_2O_3$ (FIG. 14B). The films consisting of α-$Fe_2O_3$, as well as $MoS_2$-α-$Fe_2O_3$ have uniform and dense spheres of particles. The ND hybrid with RRPHTh conducting polymer has particle sizes varying from 100 nm to 500 nm. The average size of nanoparticles of ND was kept at around 20 nm. The RRPHTh provides a nearly uniform covering over the ND particles forming the nano-hybrid structure.

FTIR

Figure 15B:
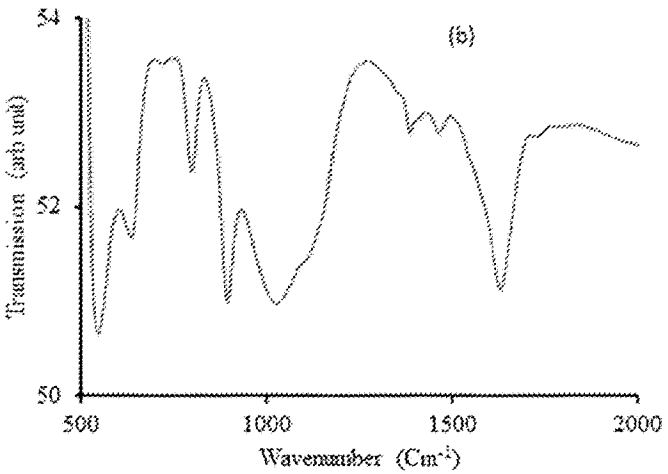
FIGS. 15A-15C show FTIR spectra of $Fe_2O_3$ (FIG. 15A), $Fe_2O_3$+0.1% $MoS_2$ (FIG. 15B), and RRPHTh+ND (FIG. 15C).
Figure 15A:
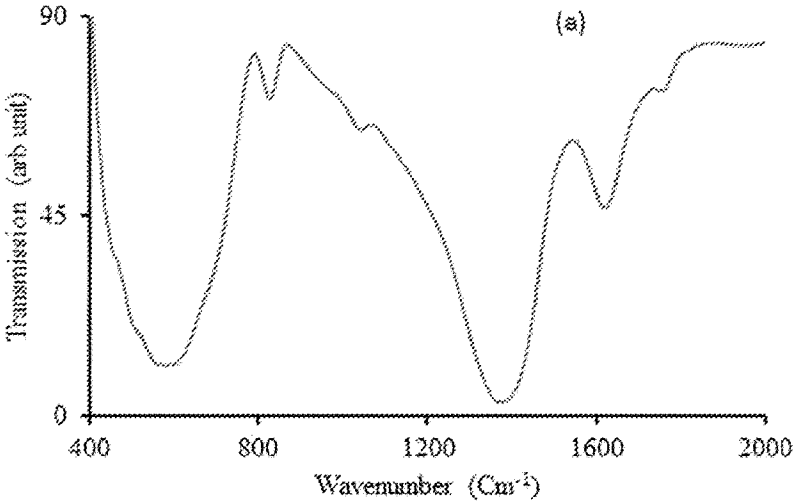
Figure 15C:
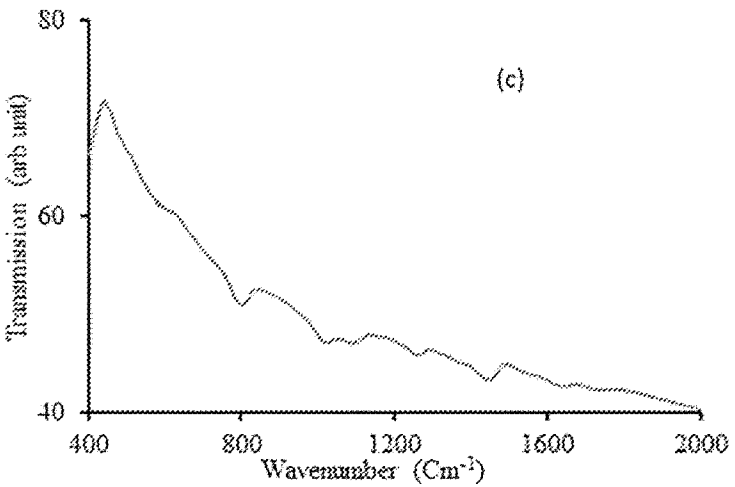

The infrared bands at 467 and 523 $cm^{-1}$ are related to Fe—O stretching and bending vibration mode for α-$Fe_2O_3$ nanomaterial as shown in FIG. 15A. FIG. 15B shows FTIR spectra of α-$Fe_2O_3$+0.1% $MoS_2$. It shows IR bands at 1388 and 1407 $cm^{-1}$ which are related to the stretching vibration as well as in-plane bending vibration of O—H of α-$Fe_2O_3$ nanomaterial. Moreover, the IR bands at 544 and 1630 $cm^{-1}$ are assigned to $OH^-$ group which is in-plane bending vibration and $\gamma_{as}$ Mo—S vibration that is due to the presence of $MoS_2$. However, the bands at 638, 802, and 892 are generated due to out of plane bending vibration and $\gamma_{as}$ Mo—O vibrations, which is related to $OH^-$ group. In addition, Fe—O presence shows stretching vibration in α-$Fe_2O_3$+0.1% $MoS_2$. FIG. 15C shows FTIR spectra of RRPHTh+ND, and various bands are also presented in Table 3. The bands at 1739 $cm^{-1}$ is the characteristics band of nanodiamond, the presence of 1687, 1129 and 630 $cm^{-1}$ are due to the presence of functional group in the nanodiamond. The RRPHTH characteristics peaks (413, 475, 514, 758, 800, 852, 1000, 1058, 1092, 1260, 1300, 1390, 1446, 1497, 1635, 1687, and 1820) are shown in FIG. 15C which can be well compared with the work of Ram et al.

TABLE 3

The infrared bands of each α-Fe2O3, 0.1% MoS2, RRPHTh + ND.

| Material | Infrared bands in $cm^{-1}$ |
|---|---|
| α-$Fe_2O_3$ | 467, 523, 578, 796, 830, 872, 990, 1046, 1076, 1376, 1551, 1625, 1736, 1763 |
| 0.1% $MoS_2$ | 512, 522, 654, 802, 1114, 1396, 1434, 1666, 2836, 2952, 3448 |
| RRPHTh + ND | 413, 475, 514, 630, 758, 800, 852, 1000, 1058, 1092, 1129, 1260, 1300, 1390, 1446, 1497, 1635, 1687, 1739, 1820, 2089, 3415, |

XRD

Figure 16B:
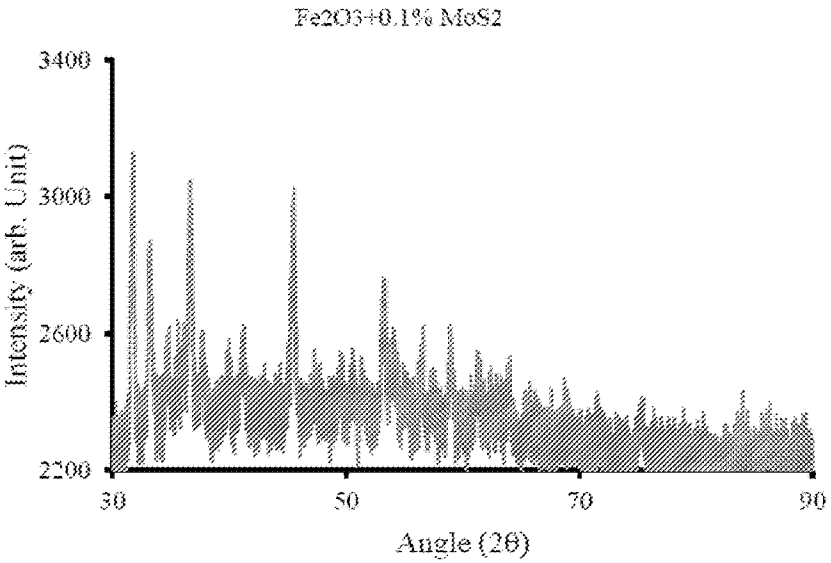
FIGS. 16A-16B show X-ray diffraction patterns of $Fe_2O_3$ (FIG. 16A) and $Fe_2O_3$+0.1% $MoS_2$ (FIG. 16B).
Figure 16A:
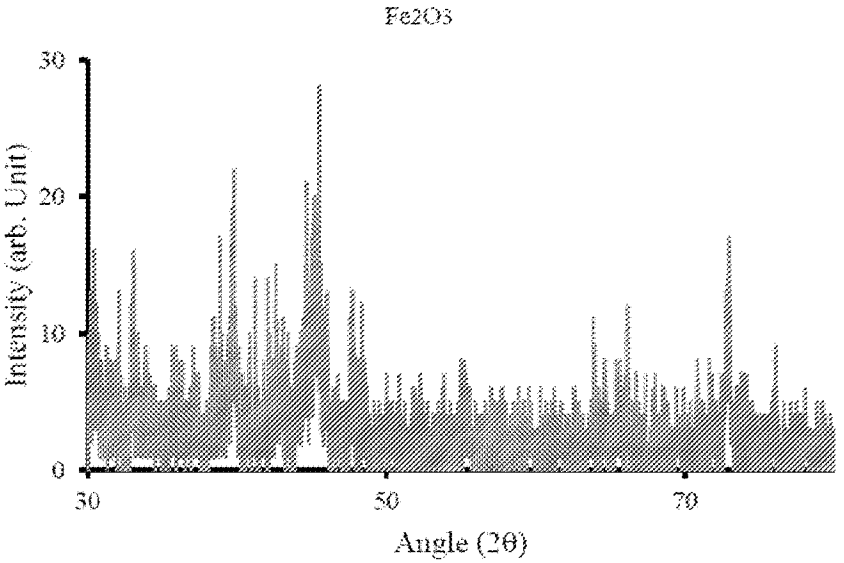

The model PAN-alytical X'Pert Pro MRD system operated at 40 kV and 40 mA was used to measure X-ray diffraction having CuKα radiation of wavelength=1.5442 Å. FIG. 16A shows XRD image of α-$Fe_2O_3$ nanomaterial. The α-$Fe_2O_3$ nanomaterial reveals a polycrystalline structure and coincides with the values as earlier investigated by Hussein et al. Table 4 shows the summary of diffraction angle 2theta angles. FIG. 16B shows the sharp diffraction angle of XRD spectra of α-$Fe_2O_3$+0.1% $MoS_2$. The sharp diffraction angle peak at 31.69 (012), 36.62 (110), 45.46 (024), 53.23 (116), 58.93 (214) are due to the crystallinity of $Fe_2O_3$ as well as the presence of doping of $MoS_2$ in α-$Fe_2O_3$+0.1% $MoS_2$ nanomaterial. However, the band at 53.23 is related to $MoS_2$ in $MoS_2$-α-$Fe_2O_3$ nanomaterial.

TABLE 4

The diffraction common peaks of each α-$Fe_2O_3$, $Fe_2O_3$ + 0.1% $MoS_2$, RRPHTh + ND

| | |
|---|---|
| $Fe_2O_3$ | 30.41, 32.11, 33.87, 39.83, 44.68, 45.54, 47.76, 63.89, 66.16, 72.96, 76.085 |
| 0.1% $MoS_2$ | 31.69, 36.62, 45.46, 53.23, 58.93 |

UV-Vis

Figure 17A:
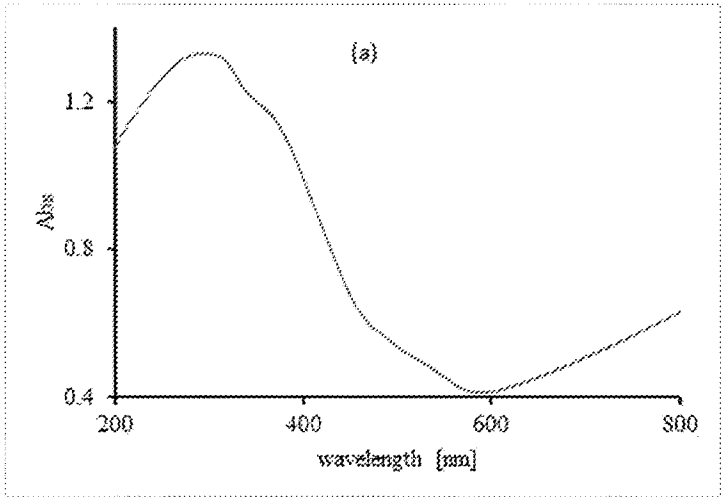
FIGS. 17A-17C show UV-vis absorption spectra of $Fe_2O_3$ (FIG. 17A), $Fe_2O_3$+0.1% $MoS_2$ (FIG. 17B), and RRPHTh+ND (FIG. 17C).
Figure 17B:
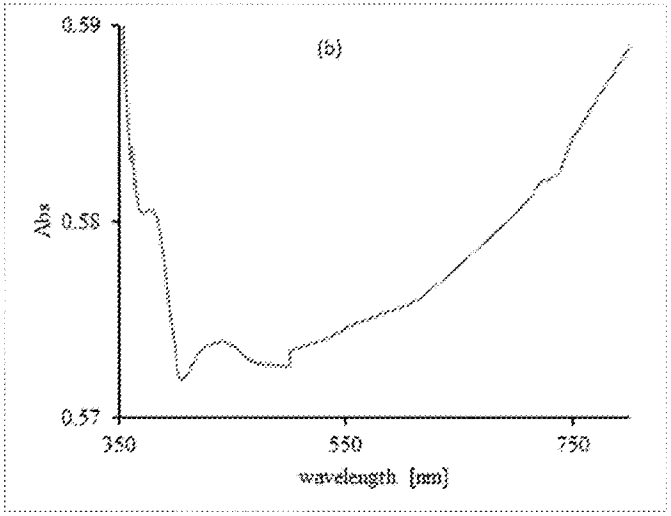
Figure 17C:
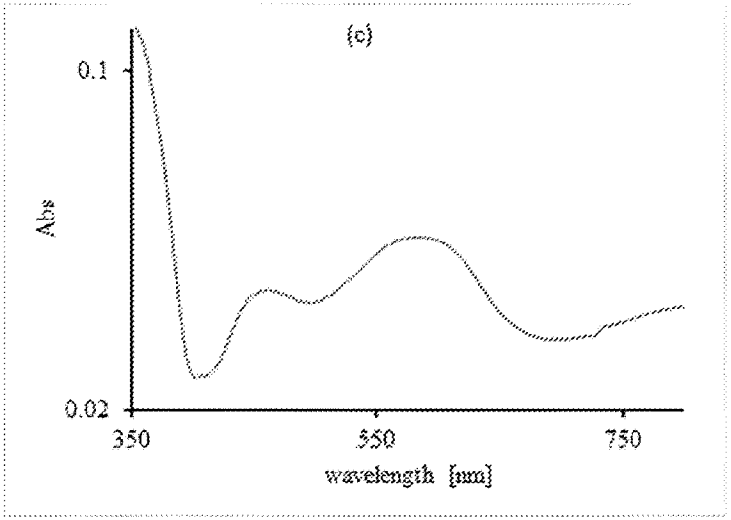
Figure 18:
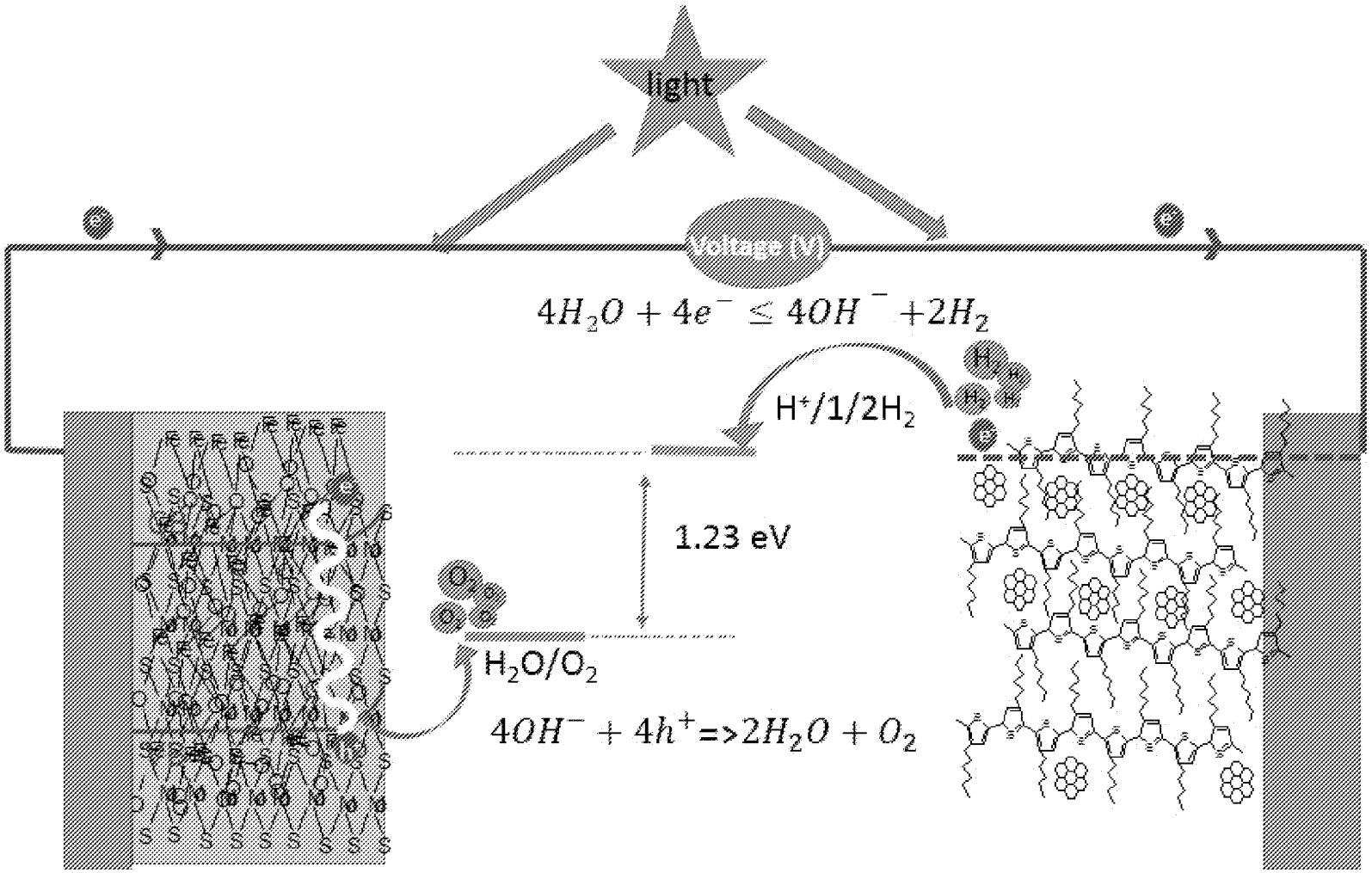
FIG. 18 shows a schematic of a water splitting application in p-type RRPHTH–ND and n-type $MoS_2$—$Fe_2O_3$ in water based electrolyte, in a photoelectrochemical cell under a photoexcitation and under potential.

An UV-Vis spectrometer Jasco V-530 was utilized to determine the absorption peaks of different nanomaterials such as α-$Fe_2O_3$, α-$Fe_2O_3$+0.1% $MoS_2$, and RRPHTh+ND (Table 5). FIG. 17A shows UV-vis absorption spectra of α-$Fe_2O_3$ film on ITO coated glass plate. The absorption band at 550 nm was depicted similar to the previous study by Hussein et al (Surface Review and Letters, 2017: p. 1950031). The characteristics absorption bands at 373, 382, 406, 442, 475, 612 nm of α-$Fe_2O_3$+0.1% $MoS_2$ were observed in FIG. 17B. FIG. 17C reveals the characteristics bands at 412, 475, 503, 588, 695, 834 nm for ND+RRPHTH based film similar to the previous work by Ram et al. (American Journal of Analytical Chemistry, 2017. 8(08): p. 523). The band gap of $MoS_2$ varies from 1.2-1.9 eV, whereas the band gap of α-$Fe_2O_3$ is 2.1 eV. So, the band gap of $MoS_2$-composite α-$Fe_2O_3$ was estimated to be in the range of 1.94 to 2.4 eV, which is well fit in the region of visible light. $MoS_2$ doping increases the conductivity of the samples. The schematic in FIG. 18 shows photogenerated electrons from conduction band (CB) of $MoS_2$ that gets transferred to CB of hematite whereas holes from hematite are transferred to valance band (VB) of $MoS_2$. This doping enhances the photocatalytic activity of $MoS_2$ composite with α-$Fe_2O_3$.

TABLE 3

The UV-vis absorption peaks of each α-$Fe_2O_3$, $Fe_2O_3$ + 0.1% $MoS_2$, RRPHTh + ND

| | |
|---|---|
| $Fe_2O_3$ | 286, 346, 371, 470, 580 |
| 0.1% $MoS_2$ | 373, 382, 406, 442, 475, 612 |
| RRPHTh +ND | 412, 475, 503, 588, 695, 834 |

Photo Electrochemical Studies on p-n Junction Based on $MoS_2$-α-$Fe_2O_3$ and RRPHTh–ND Electrodes in Photoelectrochemical Cell The $MoS_2$-α-$Fe_2O_3$ as n-electrode and RRPHTh–ND as p-electrode in liquid electrolyte (1M NaOH, HCl etc.) was studied in photoelectrochemical cells. In some studies, solid electrolyte (e.g. PVA-HCl or PVA-$H_3PO_4$ gel) based photoelectrochemical cells were also tested. The cyclic voltammetry and the chronoamperometry studied on the p-n junction based photoelectrochemical cell with and without light extensively. FIG. 18 shows the water splitting application in RRPHTH–ND as p and $MoS_2$—$Fe_2O_3$ as n-type in 1M NaOH water-based electrolyte photoelectrochemical cell under a photoexcitation and applied electrical potential. The NaOH was used as electrolyte in the photoelectrochemical cell. The cyclic voltammetry (CV) as well as the chronoamperometry measurements were made using 0.1 M and 1M concentrations of NaOH based electrolytes.

Attempts were made to understand the water splitting using work function and band gap of the material. The $MoS_2$ doped α-$Fe_2O_3$ in water has band gap varying from 2.5 to 1.94 eV. The hydrogen gas was formed at electrode of RRPHTH–ND whereas oxygen was liberated at $MoS_2$-α-$Fe_2O_3$ based electrode.

Figure 19:
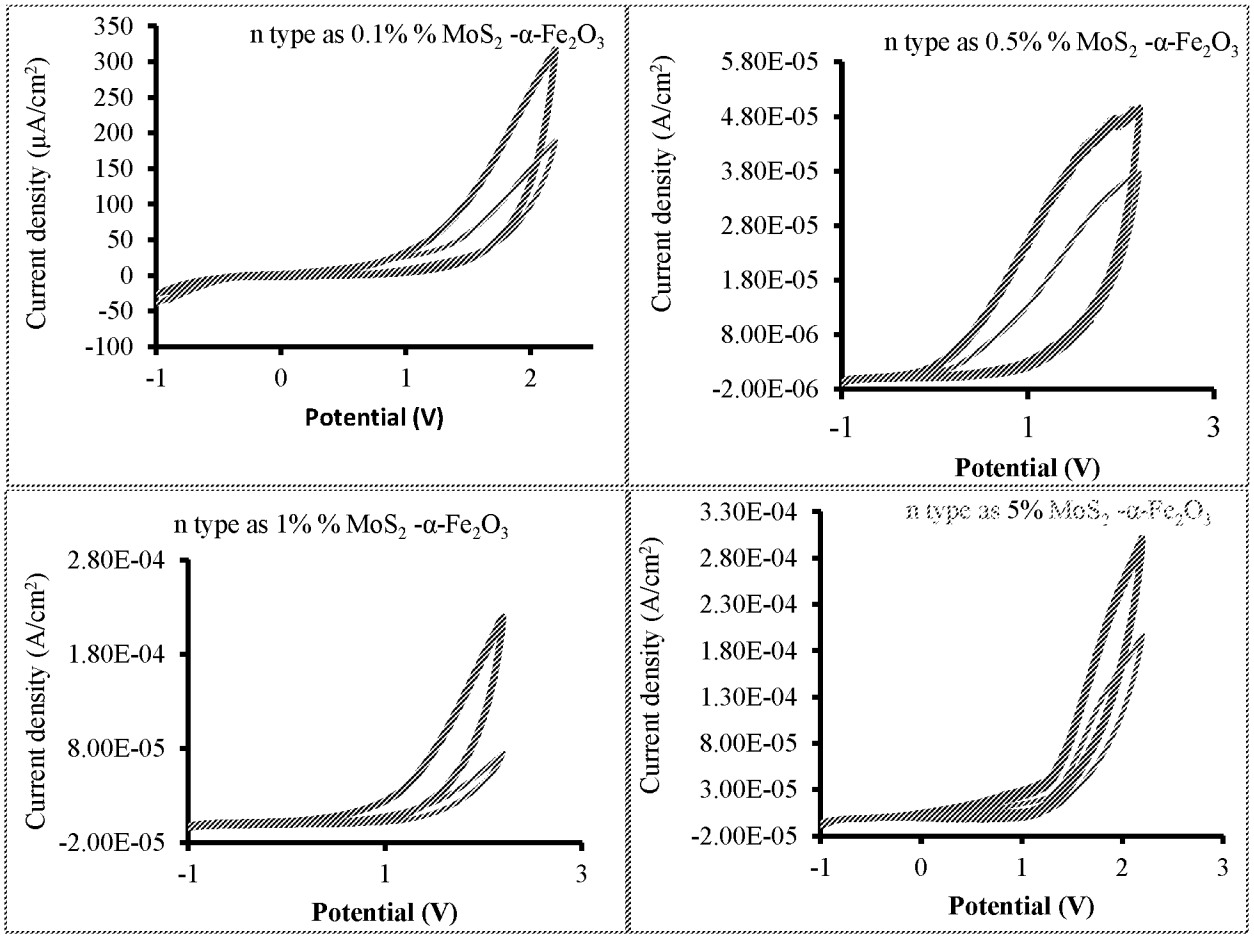
FIG. 19 shows cyclic voltammetry of p-type RRPHTH–ND and n-type $MoS_2$—$Fe_2O_3$ in about 1 M NaOH based electrolyte, in a photochemical cell with and without light.

Cyclic Voltammetry Study of $MoS_2$-α-$Fe_2O_3$ and RRPHTh–ND Electrodes in Photoelectrochemical Cell FIG. 19 shows the cyclic voltammetry curves with and without light for $MoS_2$-α-$Fe_2O_3$ and RRPHTh–ND based electrodes in 0.1M NaOH solution. The CV curves show nearly twice the value of photocurrent than without light. However, at light under 2V shows exposition the photocurrent which varies 30 times greater current for n type based electrode containing 1% $MoS_2$-α-$Fe_2O_3$ in p-type RRPHTh–ND containing 1M NaOH electrolyte.

Figure 20:
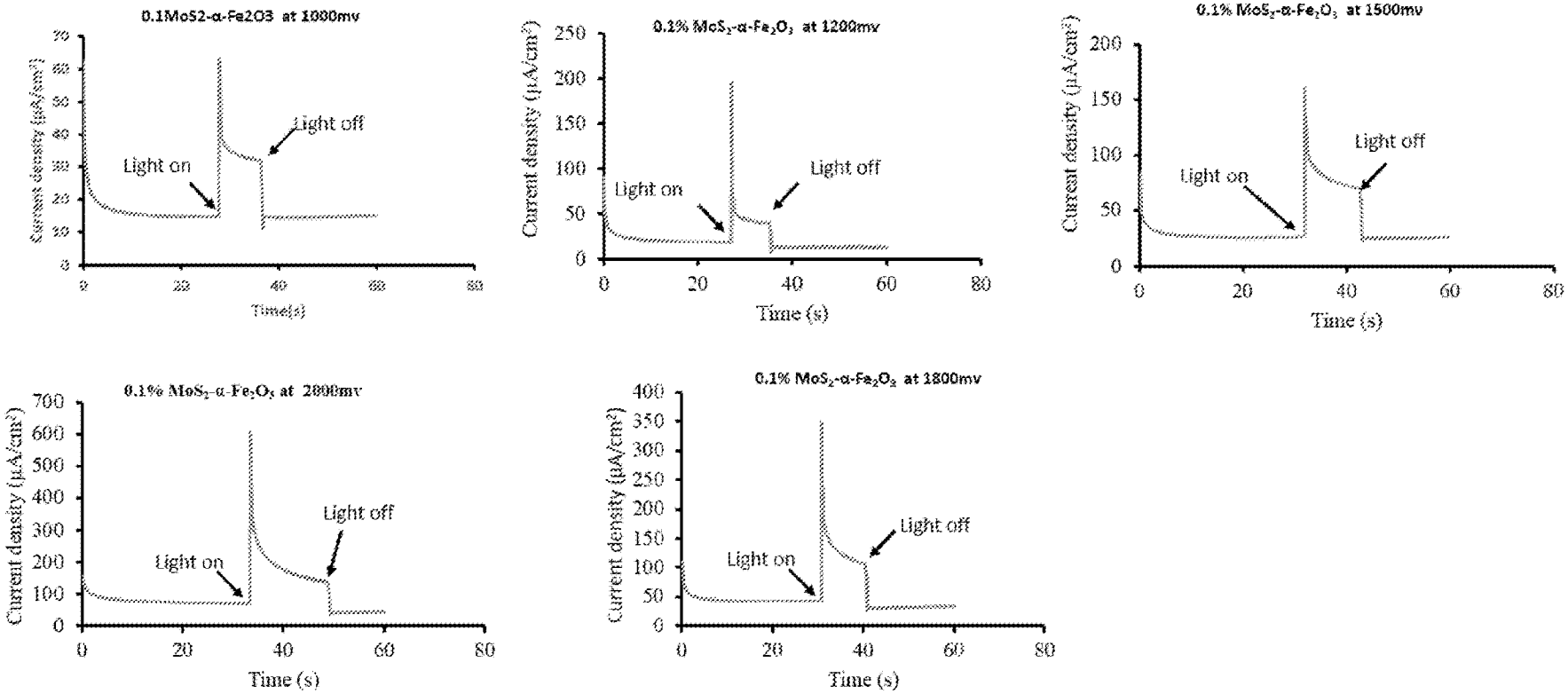
FIG. 20 shows current-transient data of p-type RRPHTH–ND and n-type 0.1% $MoS_2$—$Fe_2O_3$ electrodes in about 1 M NaOH based electrolyte, in a photoelectrochemical cell with and without light.

Chronoamperometry Study of $MoS_2$-α-$Fe_2O_3$ and RRPHTh–ND Electrodes in Photoelectrochemical Cell FIG. 20 below shows the chronoamperometry curves of $MoS_2$-α-$Fe_2O_3$ and RRPHTh–ND in 0.1 M NaOH solution. The light bulb of 60 W was exposed and the immediate current in the device increased significantly for 0.1% $MoS_2$-α-$Fe_2O_3$ as n-type and RRPHTh-ND as p-type electrode in a cell containing 0.1M NaOH electrolyte. The photocurrent is observed with the exposure to light on the cell. However, the transient current was immediately observed due to the combination of electron and hole-pair, and there is a decrease of photocurrent in 0.1% $MoS_2$-α-$Fe_2O_3$ as n-type and RRPHTh–ND as p-type electrode based electrodes in photoelectrochemical cell.

Figure 21:
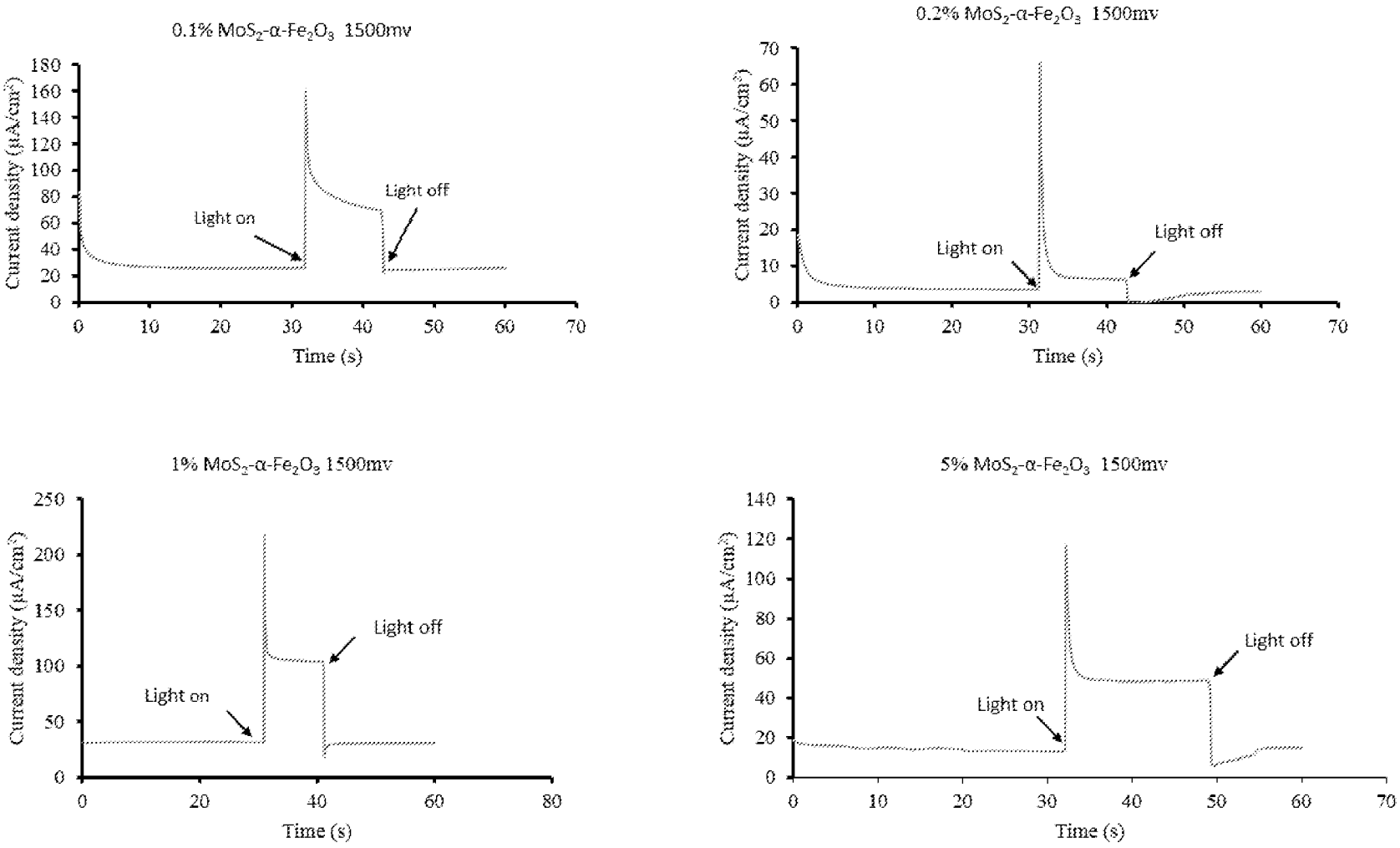
FIG. 21 shows current-transient data for a photoelectrochemical cell containing an RRPHTH–ND p-type electrode and about 0.1%, 0.2%, 1%, and 5% $MoS_2$ in $MoS_2$—$Fe_2O_3$ n-type electrodes in about 1 M NaOH based electrolyte, with a light switch on and off at an applied potential of about 1500 mV.

FIG. 21 shows chronoamperometry results of 0.1, 0.2, 1, and 5% of $MoS_2$ in α-$Fe_2O_3$ $MoS_2$ as n-type electrode and RRPHTh–ND as p-type electrode in a cell containing 0.1M NaOH electrolyte. The current density was found to be highest for 1% $MoS_2$-α-$Fe_2O_3$ as n-type electrode with RRPHTh–ND as p-type electrode in a cell containing 0.1M NaOH electrolyte. There is a current transient but it becomes a stable photocurrent after 2-3 sec whereas there is continual decrease of photocurrent in 0.1 and 0.2% of $MoS_2$ in α-$Fe_2O_3$ nanocomposite material. However, 5% of $MoS_2$ in α-$Fe_2O_3$ nanocomposite material does not reveal higher photocurrent due to aggregation of $MoS_2$ in α-$Fe_2O_3$ nanomaterial.

Figure 22:
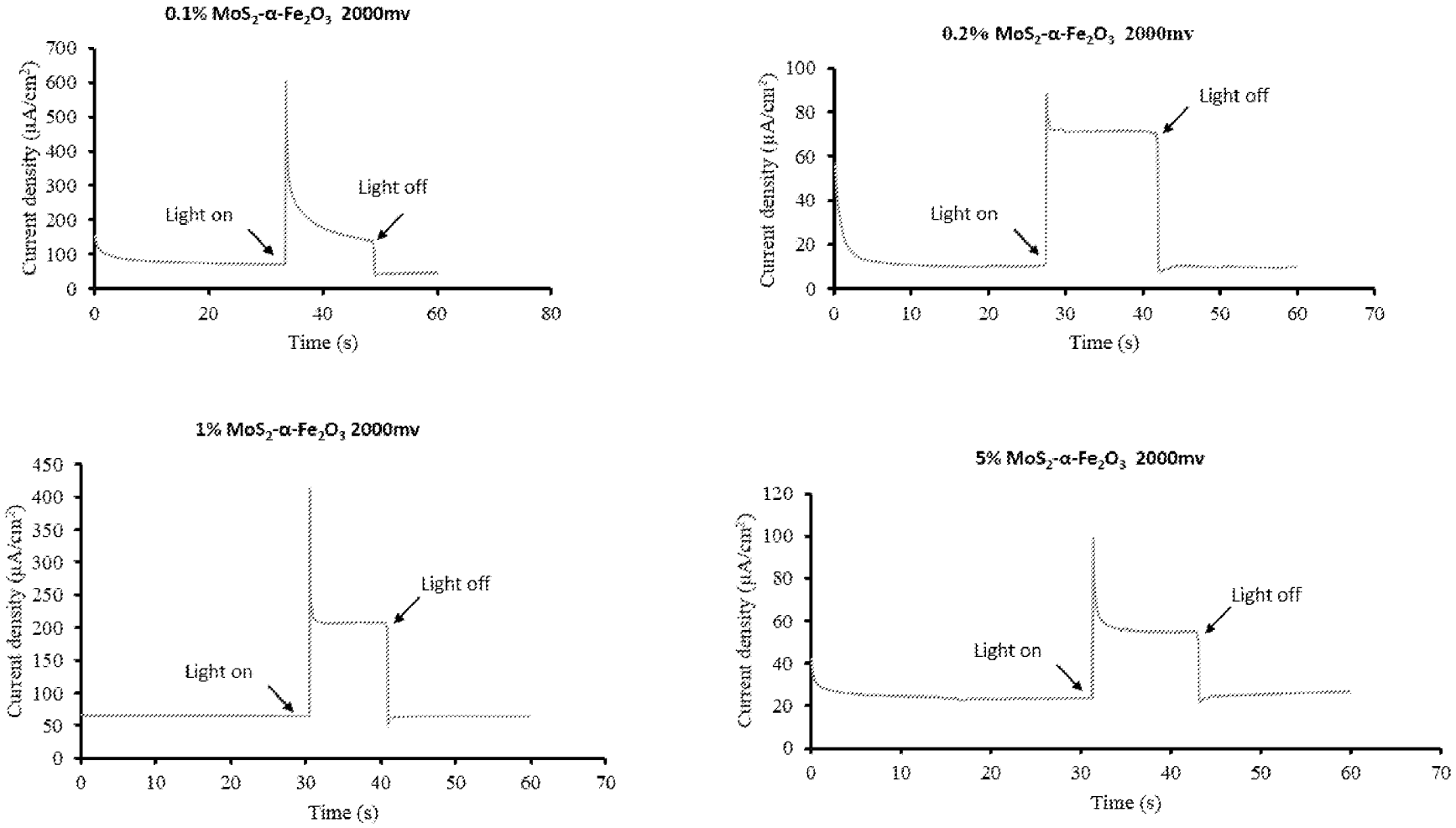
FIG. 22 shows current-transient data for a photoelectrochemical cell containing an RRPHTH–ND p-type electrode and about 0.1%, 0.2%, 1%, and 5% $MoS_2$ in $MoS_2$—$Fe_2O_3$ n-type electrodes in about 1 M NaOH based electrolyte, with a light switch on and off at an applied potential of about 2000 mV.

FIG. 22 shows chronoamperometry results of 0.1, 0.2, 1, and 5% of $MoS_2$ in α-$Fe_2O_3$ $MoS_2$ as n-type electrode and RRPHTh–ND as p-type electrode in a cell containing 0.1M NaOH electrolyte at a potential of 2000 mV. The current density was found to be highest for 0.1 and 1% $MoS_2$-α-$Fe_2O_3$ based n-type based electrode. There was a larger current transient for 0.1% $MoS_2$ in $MoS_2$-α-$Fe_2O_3$ nanocomposite material. However, stable photocurrent after 2-3 sec was also observed for 1% of $MoS_2$ in $MoS_2$-α-$Fe_2O_3$ nanocomposite nanomaterial film. The chronoamperometry results revealed that 1% $MoS_2$ in $MoS_2$-α-$Fe_2O_3$ nanocomposite was a suitable structure to obtain higher photocurrent density.

Hydrogen Production

Figure 23B:
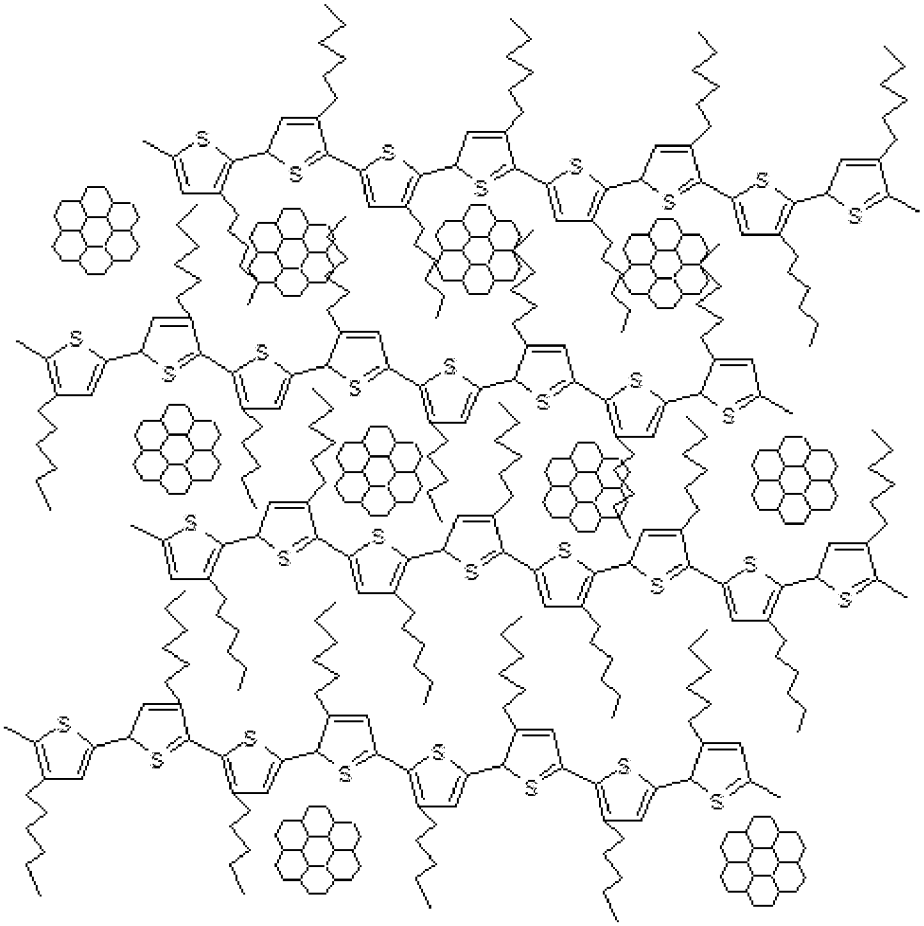
FIG. 23B shows the chemical structure of nanodiamond in a regioregular polyhexylthiophene blend structure.

FIG. 23A shows the schematic of hydrogen production using $MoS_2$-composite α-$Fe_2O_3$ photocatalyst in 1 M NaOH based electrolyte in a PEC cell. FIG. 23B shows the chemical structure of nanodiamond in a regioregular polyhexylthiophene blend structure.

Thus, $MoS_2$-α-$Fe_2O_3$ electrodes were synthesized to measure their photoelectrochemical properties in the water splitting process. The films, for example consisting of α-$Fe_2O_3$ as well $MoS_2$-α-$Fe_2O_3$, have a uniform and dense sphere of particles. The 1% $MoS_2$-α-$Fe_2O_3$ film showed the most stable photocurrent. From the XRD figure, the band at 53.23 is related to $MoS_2$ in $MoS_2$-α-$Fe_2O_3$ nanomaterial. The photoelectrochemical photocurrent was found to be dependent on the applied potential, from 0 to 2V, in an electrolyte of varying molar concentration of NaOH. The chronoamperometry results showed that 1% $MoS_2$ in $MoS_2$-α-$Fe_2O_3$ nanocomposite may be a suitable structure to obtain a higher photocurrent density. The p-n photoelectrochemical cell may be a stable photoelectrochemical cell and allows for eliminating the photo corrosion process. Also, this p-n junction may prevent the leakage of solvent and may have low absorption of light, due to the thin layer of electrolytes. The disclosed materials may provide a renewable and affordable process to produce clean energy in the form of hydrogen. Accordingly, PEC with 1% $MoS_2$-α-$Fe_2O_3$ nanocomposite has a great potential for application in fuel cell technology.

Example 3 Solid Photoelectrochemical Cell

Figure 24:
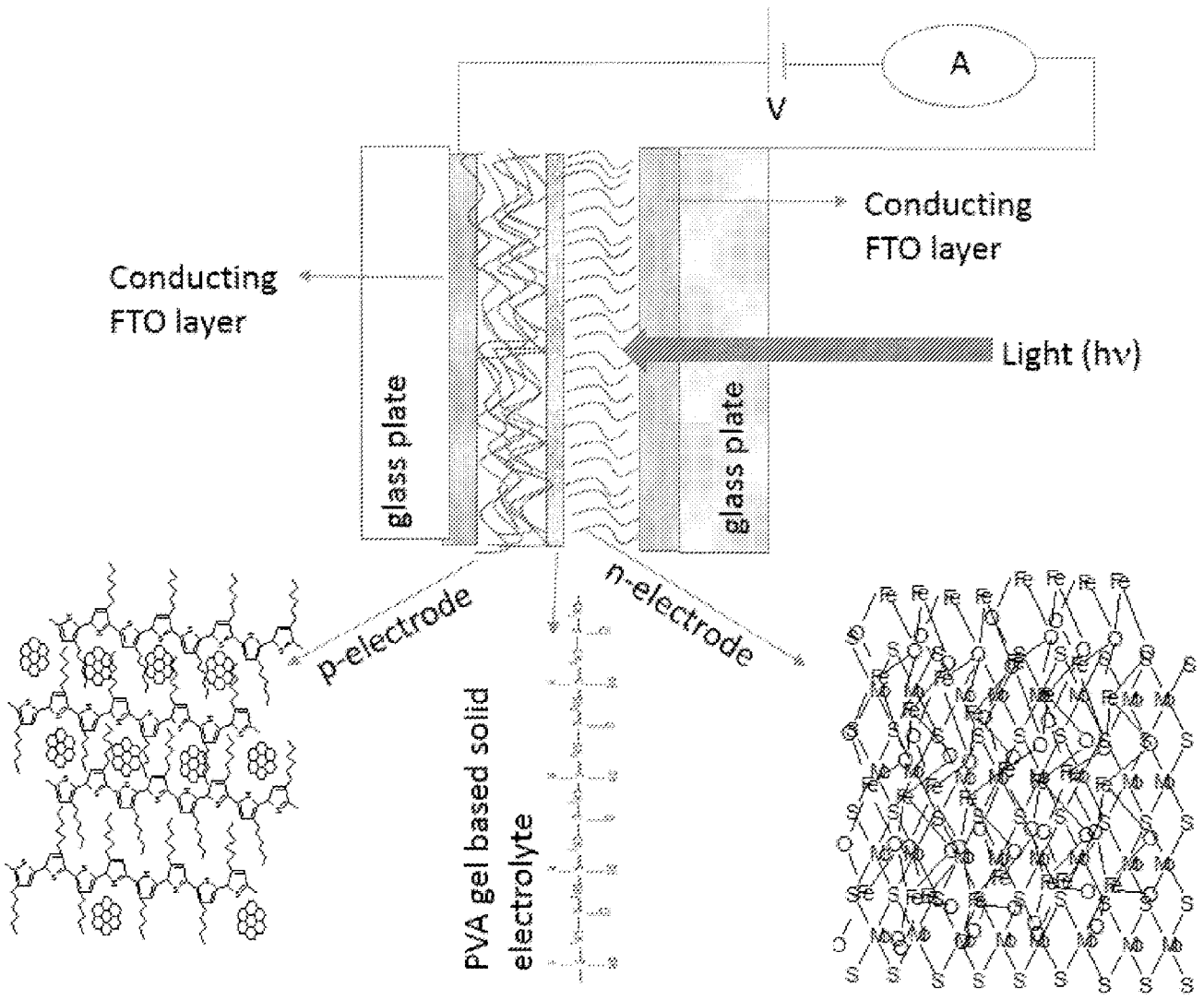
FIG. 24 shows a schematic of a solid photoelectrochemical cell.

The photocurrent is studied for the solid photoelectrochemical cell based on RRPHTh–ND as p-electrode and $MoS_2$—$Fe_2O_3$ or $TiO_2$—$Fe_2O_3$ as n-electrode in PVA-HCl based electrolyte. FIG. 24 shows the schematic of solid photoelectrochemical cell electrolyte. The n-type electrode "$MoS_2$—$Fe_2O_3$" is shown in FIG. 24. However, other n-type electrode $Fe_2O_3$—$TiO_2$, $Fe_2O_3$-zinc oxide (ZnO), $Fe_2O_3$-tin oxide ($SnO_2$), $Fe_2O_3$-tungsten oxide ($WO_3$), $Al_2O_3$—$Fe_2O_3$, or combination can be chosen for the fabrication of solid photoelectrochemical cell.

Figure 25:
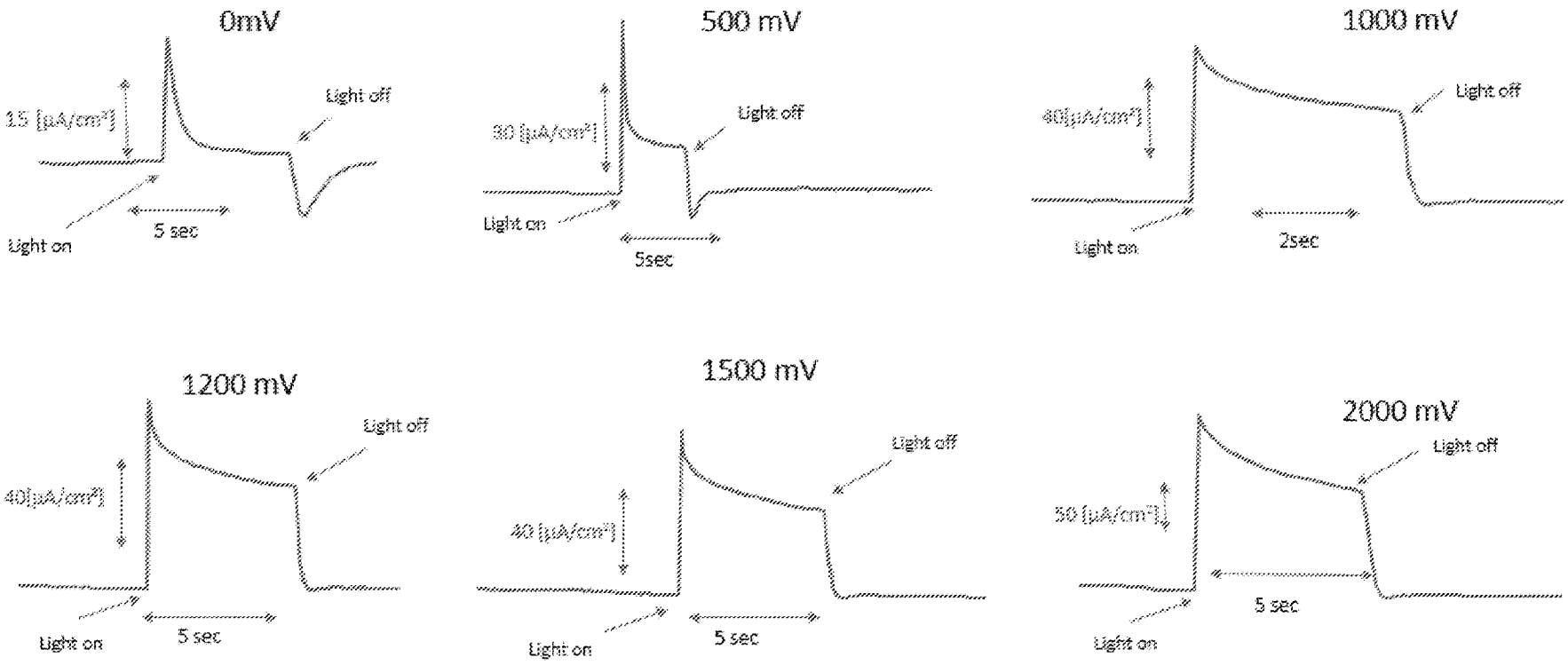
FIG. 25 shows current-transient data for a photoelectrochemical cell containing an RRPHTH–ND p-type electrode and about 1% $MoS_2$ in a $MoS_2$—$Fe_2O_3$ n-type electrode in about 1 M NaOH based electrolyte, with a light switch on and off at different applied potentials.

FIG. 25 shows the chronoamperometry studies on photoelectrochemical cell consisting of RRPHTh–ND as p-electrode and $MoS_2$—$Fe_2O_3$ as n-electrode in PVA-HCl based electrolyte. FIG. 25 shows the current transient in photoelectrochemical cell from about 0 to 2,000 mV with light switch on and off condition. The about 60 watt lamp was used for the chronoamperometry study. Interestingly, at about 0 mV potential application reveals the current transient regardless of light switch on condition for nearly about 10 sec whereas there is minor current transient for the potential varying from about 500 mV to 2,000 mV for the light switch on condition.

Figure 26:
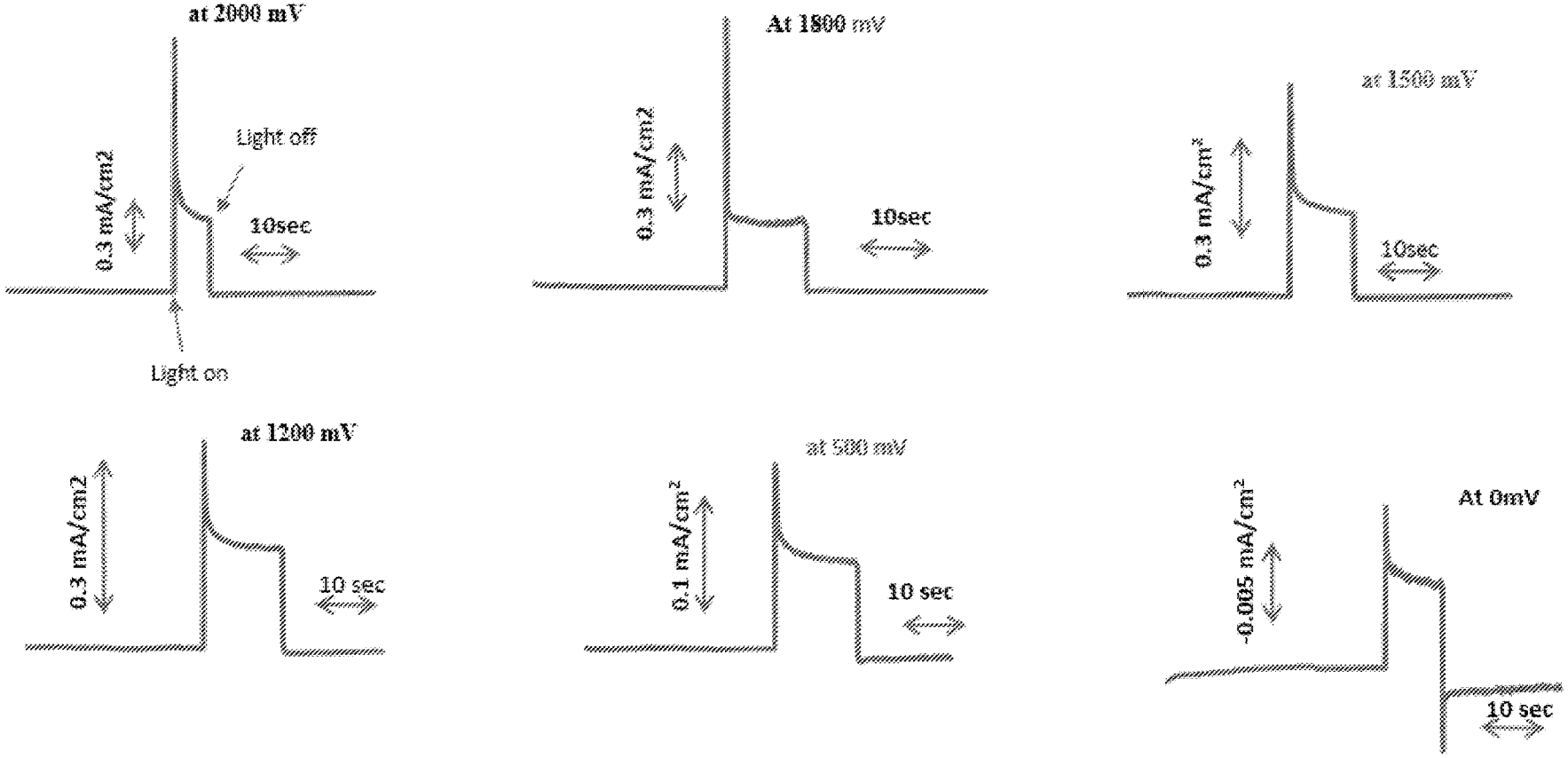
FIG. 26 shows current-transient data for a photoelectrochemical cell containing an RRPHTH–ND p-type electrode and a $TiO_2$-$\alpha$-$Fe_2O_3$ n-type electrode in about 1 M NaOH based electrolyte, with a light switch on and off at an applied potential from about 0-2000 mV.

The photoelectrochemical cell is also fabricated using the other n-type "0.05% $TiO_2$—$Fe_2O_3$" and RRPHTh–ND as p-electrode in PVA-HCl gel based electrolyte. The current density is nearly a hundred times larger than the light switch on condition. The photocurrent has been obtained for each potential from about 0 to 2,000 mV application to the cell (FIG. 26).

As disclosed herein, α-$Fe_2O$—$MoS_2$ electrode was synthesized and the photoelectrochemical properties were measured. About 1% $MoS_2$-α-$Fe_2O_3$ shows the stable photocurrent. The photoelectrochemical photocurrent is dependent to the applied potential from about 0 to 2 V in an electrolyte of varying molar concentration of NaOH. The disclosure is also about the configuration of photoelectrochemical cell for hydrogen splitting through anode and cathode electrodes. Later, about 1% $MoS_2$-α-$Fe_2O_3$ deposited on conducting ITO glass plate and RRPHTH–ND deposited on silicon or conducting FTO glass plates were sandwiched using polyvinyl alcohol (PVA)-hydrochloric acid based gel to fabricate solid gel based photoelectrochemical cell. The solid gel based p-n photoelectrochemical cell has been studied under about 60 watt and solar simulated light which shows the about 100 order magnitude of photocurrent at different applied potential. The p-n photoelectrochemical cell shows stable solid state photoelectrochemical cell and eliminates the photocorrosion process, prevents the leakage of solvent, and has low absorption of light due to thin layer of electrolyte.

Thus, the invention provides, among other things, a photoelectrochemical cell. Various features and advantages of the invention are set forth in the following claims.

What is claimed is:

1. A method of generating hydrogen from water, the method comprising providing a photoelectrochemical cell comprising:

(a) an n-type electrode comprising a nanocomposite film comprising a nanomaterial including α-hematite and a metal dichalcogenide, wherein the nanomaterial has an average particle size of from 459 nanometers to 825 nanometers;

(b) a p-type electrode comprising a conducting polymer; and (c) an electrolyte.

2. The method of claim 1, wherein the photoelectrochemical cell comprises nanodiamond-regioregular polyhexylthiophene (ND-RRPHTh) blend film as the p-type electrode, $MoS_2$-α-hematite as the n-type electrode, and an acidic or a basic solution.

3. The method of claim 1 further comprising:

(b) splitting water into hydrogen and oxygen by means of photocurrent from a p-n junction of the electrochemical cell.

4. The method of claim 3, wherein the photocurrent is obtained at a potential from about 0 V to about 2,000 V.

5. The method of claim 1, wherein the nanocomposite film comprises a dopant selected from the group consisting of platinum, tin, cobalt, zinc, palladium, titanium, chromium, rhodium, iridium, and combinations thereof.

6. The method of claim 1, wherein the electrolyte is an aqueous electrolyte comprising sodium hydroxide, potassium hydroxide, magnesium hydroxide, lithium hydroxide, sodium chloride, potassium chloride, magnesium chloride, hydrochloric acid, sulfuric acid, nitric acid, acetic acid, butyric acid, lactic acid, oxalic acid, myristic acid, and/or perchloric acid.

7. The method of claim 1, wherein the electrolyte is a gel comprising a polymer and an acid.

8. The method of claim 1, wherein the conducting polymer is selected from the group consisting of polythiophenes, polyhexylthiophene, regioregular polyhexylthiophene, polyethylenedioxythiophene, polymethylthiophene, polydodcylthiophene, polycarbazole, poly (n-vinylcarbazole), substituted polyethylenedioxythiophenes, polydiooxythiophene, polyaniline, n-poly(N-methyl aniline), poly(o-ethoxyaniline), poly(o-toluidine), polyphenylene vinylene), and combinations thereof.

9. The method of claim 1, wherein the nanocomposite film is deposited on a conducting fluorine tin oxide (FTO) coated glass plate.

10. The method of claim 1, wherein the n-type electrode comprises $MoS_2$-α-$Fe_2O_3$.

11. The method of claim 1, wherein the nanocomposite film has from 0.1 wt. % to 5 wt. % $MoS_2$.

12. The method of claim 1, wherein the metal dichalcogenide is selected from the group consisting of molybdenum disulfide, tungsten disulfide, molybdenum diselenide, molybdenum telluride, tungsten selenide, and combinations thereof.

13. The method of claim 1, wherein:

the electrolyte is a gel comprising a polymer and an acid, and the polymer of the gel is selected from the group consisting of polyvinyl alcohol, poly(vinyl acetate), poly (vinyl alcohol co-vinyl acetate), poly(methyl methacrylate), poly(vinyl alcohol-co-ethylene ethylene), poly (vinyl butyral-co-vinyl alcohol-co-vinyl acetate), polyvinyl butyral, polyvinyl chloride, polystyrene, and combinations thereof, and the acid of the gel is selected from the group consisting of acetic acid, propionic acid, hydrochloric acid, hydrofluoric acid, phosphoric acid, sulfuric acid, formic acid, benzoic acid, hydrofluoric acid, nitric acid, phosphoric acid, sulfuric acid, tungstosilicic acid hydrate, hydriodic acid, carboxylic acid, and combinations thereof.

14. The method of claim 1, wherein the conducting polymer is polyhexylthiophene.

* * * * *